US005427525A

United States Patent [19]

Shukla et al.

[11] Patent Number: 5,427,525

[45] Date of Patent: Jun. 27, 1995

[54] LOX $NO_x$ STAGED ATMOSPHERIC BURNER

[75] Inventors: Kailash C. Shukla, Stow; Maurice Nunes, Arlington; Dean T. Morgan, Sudbury, all of Mass.

[73] Assignee: Southern California Gas Company, Los Angeles, Calif.

[21] Appl. No.: 86,326

[22] Filed: Jul. 1, 1993

[51] Int. Cl.[6] ..... F23D 14/02

[52] U.S. Cl. ..... 431/350; 431/10; 431/326; 431/328; 126/350 R

[58] Field of Search ..... 431/10, 7, 326, 328, 431/329, 350, 351, 354, 171, 172; 126/39 E, 91 R, 92 C, 92 AC, 350 R, 39 K

[56] References Cited

U.S. PATENT DOCUMENTS

| | | | |
|---|---|---|---|
| 1,139,698 | 5/1915 | Merrill | 431/172 |
| 2,143,908 | 1/1939 | Burtlins | 431/172 K |
| 2,497,321 | 2/1950 | Pattinson et al. | 431/172 |
| 3,087,484 | 4/1963 | Eddy | 431/329 |
| 3,832,122 | 8/1974 | La Haye et al. | 431/10 |
| 3,837,788 | 9/1974 | Craig et al. | 431/351 |
| 3,868,211 | 2/1975 | Haye et al. | 431/10 |
| 3,885,903 | 5/1975 | La Haye | 431/8 |
| 3,955,909 | 5/1976 | Craig et al. | 431/10 |
| 4,004,875 | 1/1977 | Zink et al. | 431/9 |
| 4,013,399 | 3/1977 | Craig et al. | 431/351 |
| 4,021,186 | 5/1977 | Tenner | 431/10 |
| 4,021,191 | 5/1977 | La Haye | 431/353 |
| 4,050,877 | 9/1977 | Craig et al. | 431/76 |
| 4,113,417 | 9/1978 | Deruelle | 431/5 |
| 4,257,763 | 3/1981 | Reed | 431/188 |
| 4,297.093 | 10/1981 | Morimoto et al. | 431/10 |
| 4,505,666 | 3/1985 | Martin et al. | 431/175 |
| 4,629,413 | 12/1986 | Michelson et al. | 431/9 |
| 4,842,509 | 6/1989 | Hasenack | 431/10 |
| 4,927,349 | 5/1990 | Schirmer et al. | 431/10 |
| 5,022,849 | 6/1991 | Yoshii et al. | 431/2 |
| 5,080,577 | 1/1992 | Bell et al. | 431/7 |

FOREIGN PATENT DOCUMENTS

| | | | |
|---|---|---|---|
| 2360158 | 8/1974 | Germany | 431/172 |
| 0035425 | 3/1979 | Japan . | |
| 0150706 | 9/1983 | Japan | 431/10 |
| 0004713 | 1/1985 | Japan | 431/329 |
| 0013918 | 1/1987 | Japan | 431/10 |
| 0186114 | 8/1987 | Japan | 431/10 |
| 0156204 | 7/1991 | Japan | 431/326 |
| WO91/10864 | 7/1991 | WIPO | 431/10 |

*Primary Examiner*—Carl D. Price
*Attorney, Agent, or Firm*—Fish & Richardson

[57] ABSTRACT

A two stage, atmospherically supplied burner which produces reduced levels of $NO_x$ in applications such as residential water heaters or light commercial applications. A novel, perforated plate first stage burner is disclosed for first stage combustion. A variety of embodiments disclose various approaches to supplying atmospheric to support second stage combustion. A conventional first stage burner is also disclosed with modifications to achieve two-stage, atmospherically supplied combustion.

6 Claims, 25 Drawing Sheets

LOX $NO_x$ STAGED ATMOSPHERIC BURNER

BACKGROUND OF THE INVENTION

The invention relates to two-stage, atmospherically supplied burners, for small scale (e.g., residential or light commercial) heating applications, which produce reduced levels of nitrogen oxide ($NO_x$) emissions. A typical application for such a burner might be in a residential or small commercial water heater.

It is known in the art of fuel combustion that $NO_x$ emission levels may be reduced by staging combustion. Primary, or first stage, combustion is run fuel rich, i.e., there is more fuel gas in the gas/air mixture supplying the first stage than is required for stoichiometric combustion. Additional air is supplied in the second stage to complete combustion.

Because of various factors, however, staged combustion as known in the art is not readily adaptable to the applications to which the current invention is directed. For example, commercial and industrial burners often use powered combustion; residential burners, on the other hand, make use of natural draft, referred to as atmospheric combustion. Atmospheric combustion does not provide the mixing, turbulence, or air/fuel ratio control necessary to effect reduced $NO_x$ levels as currently practiced in the art.

Despite these limitations, atmospherically supplied burners are preferred in the residential or light commercial setting. This is due to their much lower cost, simplicity of design, and ease of maintenance.

SUMMARY OF THE INVENTION

According to a first aspect of the invention, a low $NO_x$ emitting, atmospherically-supplied two-stage burner features a first stage burner which has a plenum, and a perforated portion which allows gas to flow out of said plenum. First stage combustion, which is run fuel rich, is supported at the perforated portion of the first stage burner. Means are provided to mix the effluent from the first stage flame with atmospherically supplied air flowing into the burn chamber under the influence of natural draft action so as to produce second stage combustion. The means include a top plate located above the first stage burner. The means may further include a vertical tube, centrally disposed relative to the first stage burner, which directs a circumferential stream of atmospherically supplied air into the stream of effluent.

The first stage burner may be inward firing, top firing, or outward firing. A gas supply line injects a stream of raw gas into the burner plenum, and air for first stage combustion is aspirated into the plenum by the jet of gas. Alternatively, a premixed mixture of gas and air is delivered to the plenum by the supply line. First stage combustion is run with approximately 60% of the oxygen necessary for stoichiometric combustion of the gas.

According to a second aspect of the invention, a low $NO_x$ emitting, atmospherically-supplied two-stage burner features a conventional first stage burner having a circumferential series of burn ports. Means for mixing the stream of effluent produced by first stage combustion include a cup shaped bottom baffle which cups the first stage burner from below, and a top plate disposed above the first stage burner. The stream of effluent flows through a gap defined by the bottom baffle and top plate, and mixes with atmospherically supplied air flowing upward about the bottom baffle to yield second stage combustion. First stage combustion is run fuel rich, with approximately 60% of the oxygen necessary for stoichiometric combustion of the gas.

In operation, reduced levels of $NO_x$ are achieved by operating the first stage combustion fuel rich i.e., less air than is required for stoichiometric combustion is supplied to the first stage. Mixing of the atmospherically supplied air with the stream of effluent is delayed so as to allow heat to be transferred out of the stream of effluent which results in a lower second stage flame temperature. The lower second stage flame temperature is partially responsible for the reduced levels of NO.

Unlike staged low $NO_x$ burners known in the art which require forced or metered supplies of combustion air to operate, the low $NO_x$ burner of the invention works with atmospherically supplied air which flows into the burn chamber through natural draft action. This achievement permits simple economic manufacturing conducive to use in residential or light commercial applications such as residential or commercial water heaters, while reducing $NO_x$emissions.

DESCRIPTION OF THE PREFERRED EMBODIMENTS

The burner of the invention is a two stage burner. The first stage is run fuel rich—i.e., less air is provided in the gas/air mixture than is required for stoichiometric combustion—which produces no oxygen in the effluent. Typically, first stage combustion is run with approximately 60% of stoichiometric air. In the second stage, additional, atmospherically supplied air is mixed with the effluent from the first stage combustion which is then burned at low excess air to complete combustion.

Because the first stage is run fuel rich, there is reduced oxygen availability which reduces the level of $NO_x$ formed. Reduced oxygen availability also leads to lower flame temperature, another factor in reducing $NO_x$ levels.

In the second stage, $NO_x$ formation is discouraged due to reduced oxygen content, lower flame temperature (which results from heat being drawn off by the particular heating application for which the burner is being used), and minimized time the combustion gases stay at high temperature.

A variety of low $NO_x$ burner configurations have been developed which achieve the desired reduction in the level of $NO_x$ produced by the burner. They will now be described with reference to the accompanying drawings.

Figure 1:
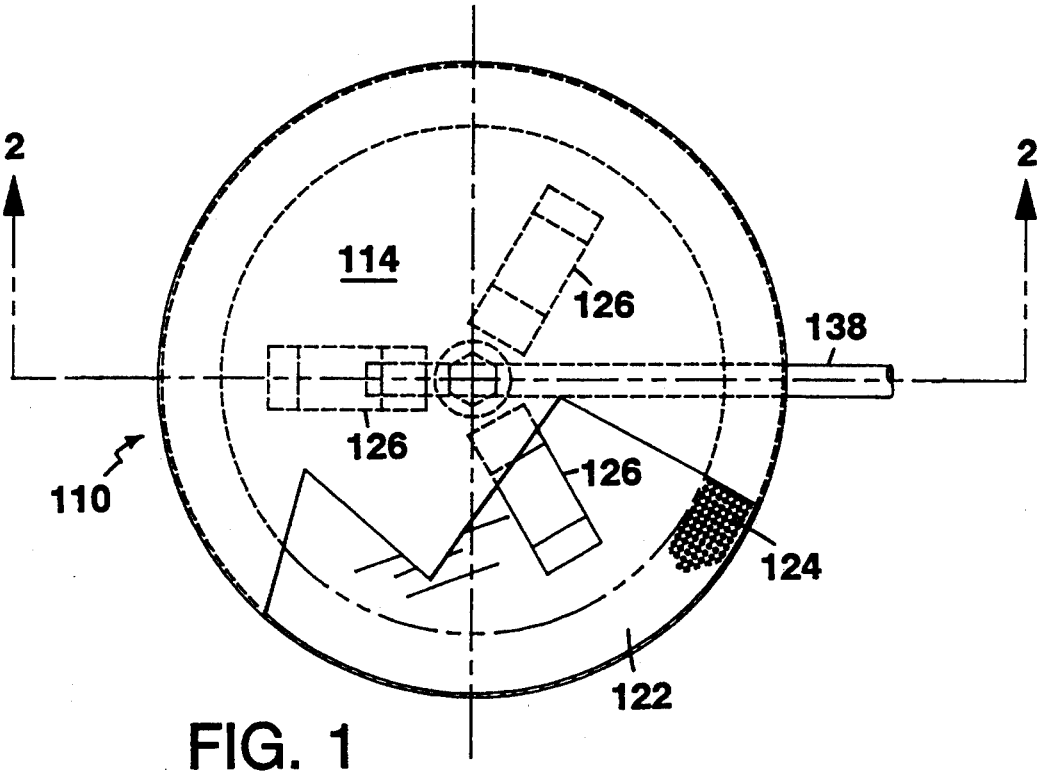
FIGS. 1–3, 5–34 are schematic drawings showing various embodiments of perforated plate, plenum type two-stage, low $NO_x$ burners according to a first aspect of the invention. Each embodiment is shown in a group of three consecutive Figures: the first Figure in each group is a plan view, with a portion of the top plate broken out; the second Figure is a sectional elevational view taken along the section line in the first Figure; and the third Figure is a schematic elevational view showing the burner in a residential or light commercial water heater.
Figure 2:
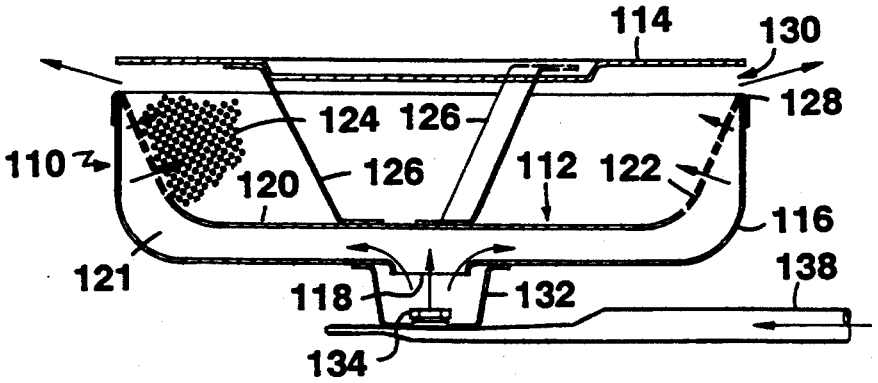
Figure 3:
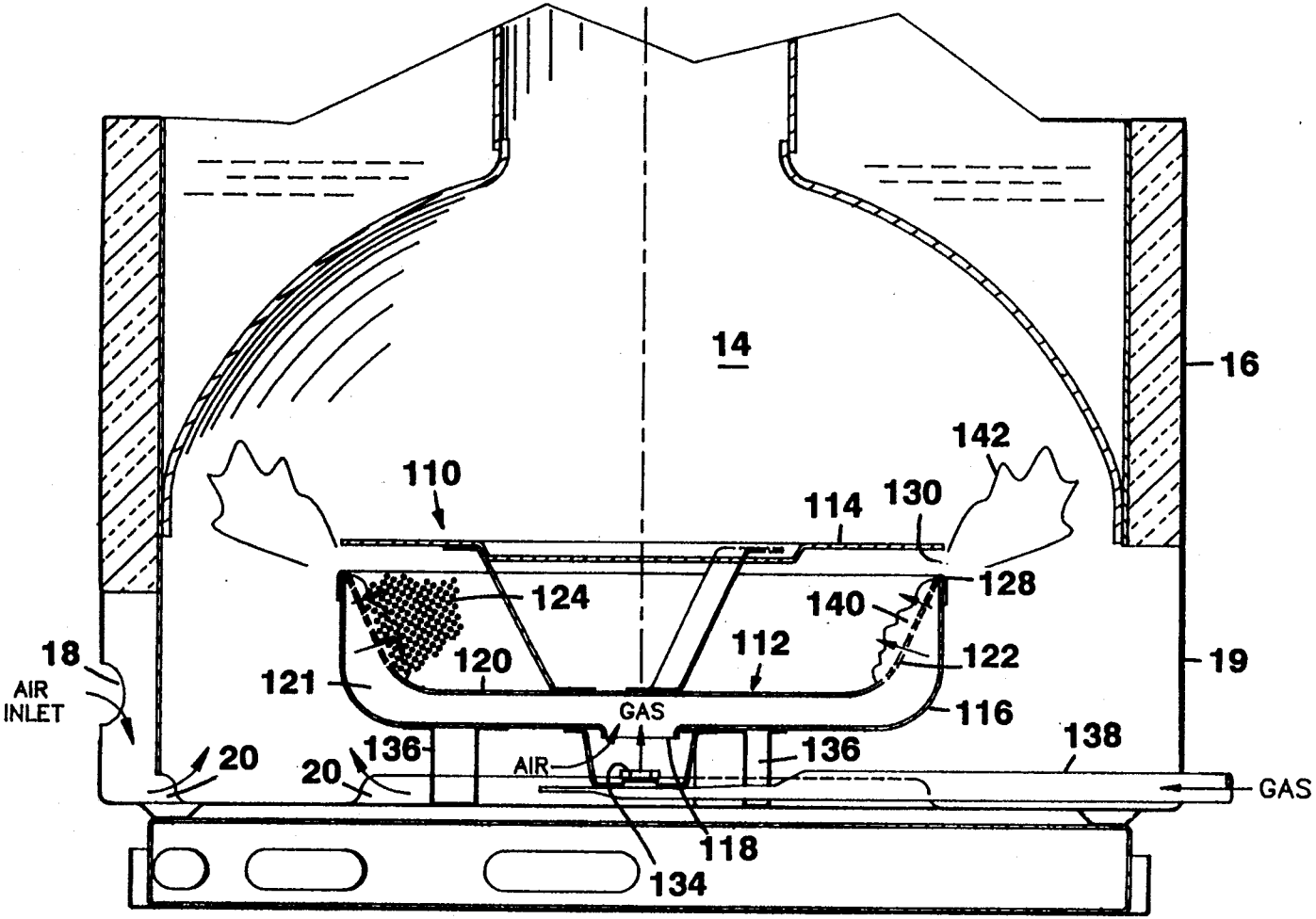

As shown in FIGS. 1–3, a preferred embodiment of a low $NO_x$ burner 110 comprises first stage burner 112 and dish-shaped top plate 114. First stage burner 112 is comprised of bottom bowl 116, which has a centrally located gas inlet 118, and nested top bowl 120. Bottom bowl 116 and top bowl 120 define plenum 121. Both bottom bowl 116 and top bowl 120 are made from 0.030 inch thick, stainless steel sheet metal. The sloping, inward facing outer portion 122 of top bowl 120 is perforated, as indicated by stippling 124.

Figure 4:
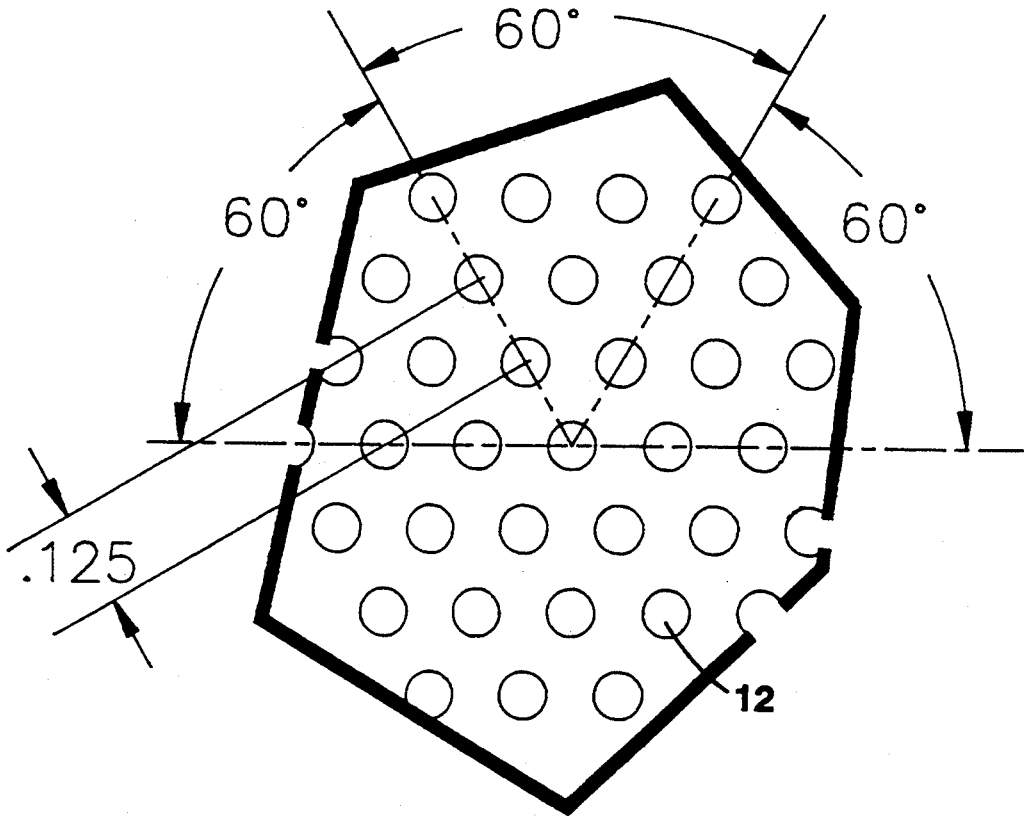
FIG. 4 is a schematic plan view showing the configuration of the perforations in the embodiments shown in FIGS. 1–3 and 5–34.

As shown in FIG. 4, the perforations 12 are 1/16 inch diameter holes through the sheet metal, arranged in equilaterally triangular fashion, spaced ⅛ inch apart from center to center. This results in 23% of the surface area being open, where the sheet metal is perforated.

Top plate 114 is supported above top bowl 120 by stand-offs 126. Top plate 114 should be approximately the same diameter as first stage burner 112 (outer diameter), and should be approximately one inch above the top edge 128 of the first stage burner. This arrangement defines circumferential second stage burn gap 130. The whole assembly is supported, by U-shaped bracket 132, above injector nipple 134.

As shown in FIG. 3, low $NO_x$ burner 110 is located within the burn chamber 14 of a standard residential or light commercial water heater 16. It is supported by stand-offs 136. Gas line 138 supplies raw natural gas to low $NO_x$ burner 110, and the natural gas is injected into plenum 121 by injector nipple 134.

Oxygen necessary for combustion is supplied by atmospheric air, which flows into burn chamber 14 through air inlets 18 and air slots 20, located near the bottom of burn chamber 14. The air is drawn in by natural draft action, as hot exhaust gases flow out of burn chamber 14 through exhaust stack 22. Atmospheric air is aspirated into plenum 121 by the jet of gas entering plenum 121 through gas inlet 118, and the gas and air are mixed as they impinge upon the underside of top bowl 120. Ideally, this air should supply approximately 60% of the oxygen required for stoichiometric combustion of the gas. Proper proportioning may be effected by varying the mass flow rate and/or velocity of the gas being injected, the diameter of gas inlet 118, or the choke effect created by the proximity of top bowl 120 to bottom bowl 116.

The gas/air mixture spreads throughout plenum 121 and flows out of plenum 121 through the perforated outer portion 122 of top bowl 120. A standing gas pilot (not shown) ignites the outflowing gas/air mixture, resulting in first stage combustion which is represented by first stage flame 140. Because the first stage combustion is run fuel rich, the gas is not entirely combusted. A stream of effluent (not shown) from first stage flame 140, containing unburned gas, passes through second stage burn gap 130. At this point, the stream of effluent mixes with atmospheric air flowing upward along the outside of bottom bowl 116, spontaneously igniting in second stage combustion which is represented by second stage flame 142.

Figure 5:
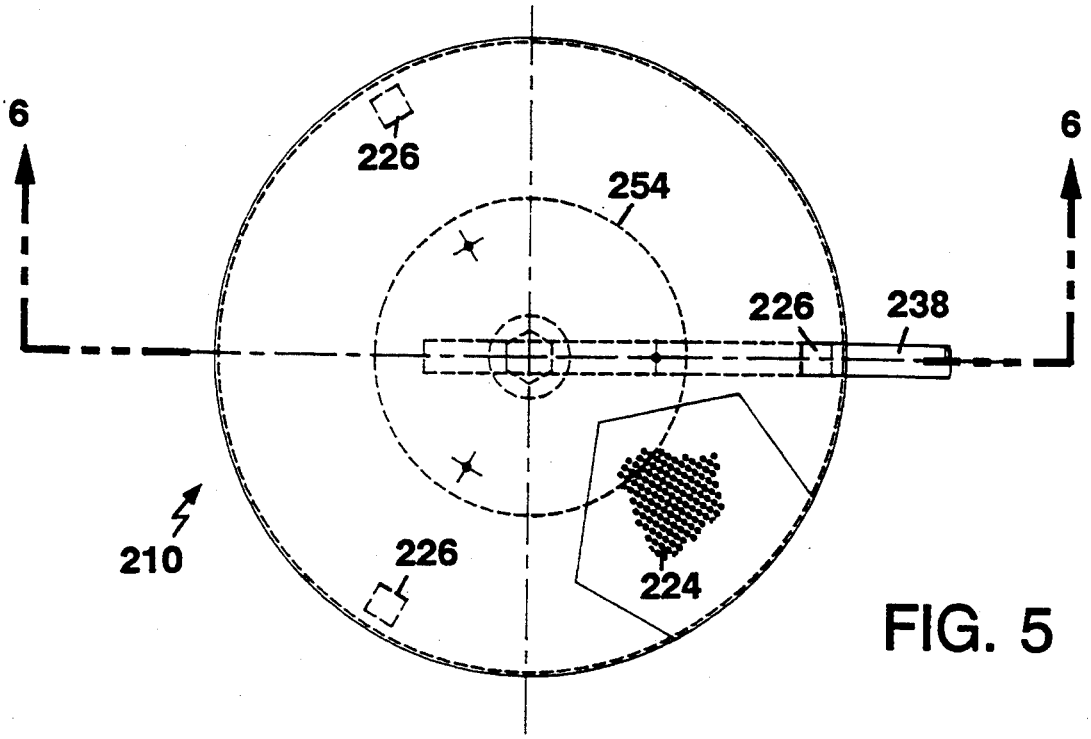
Figure 6:
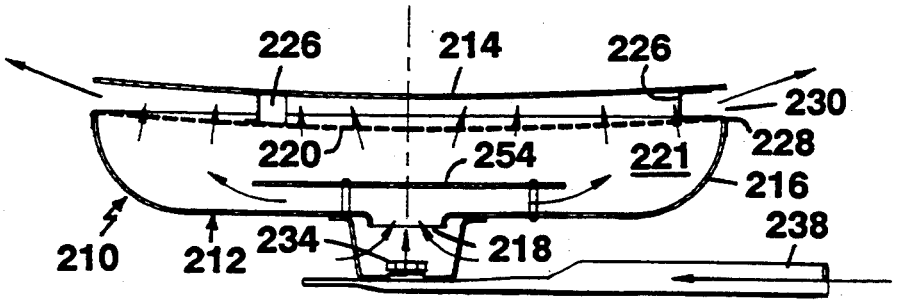
Figure 7:
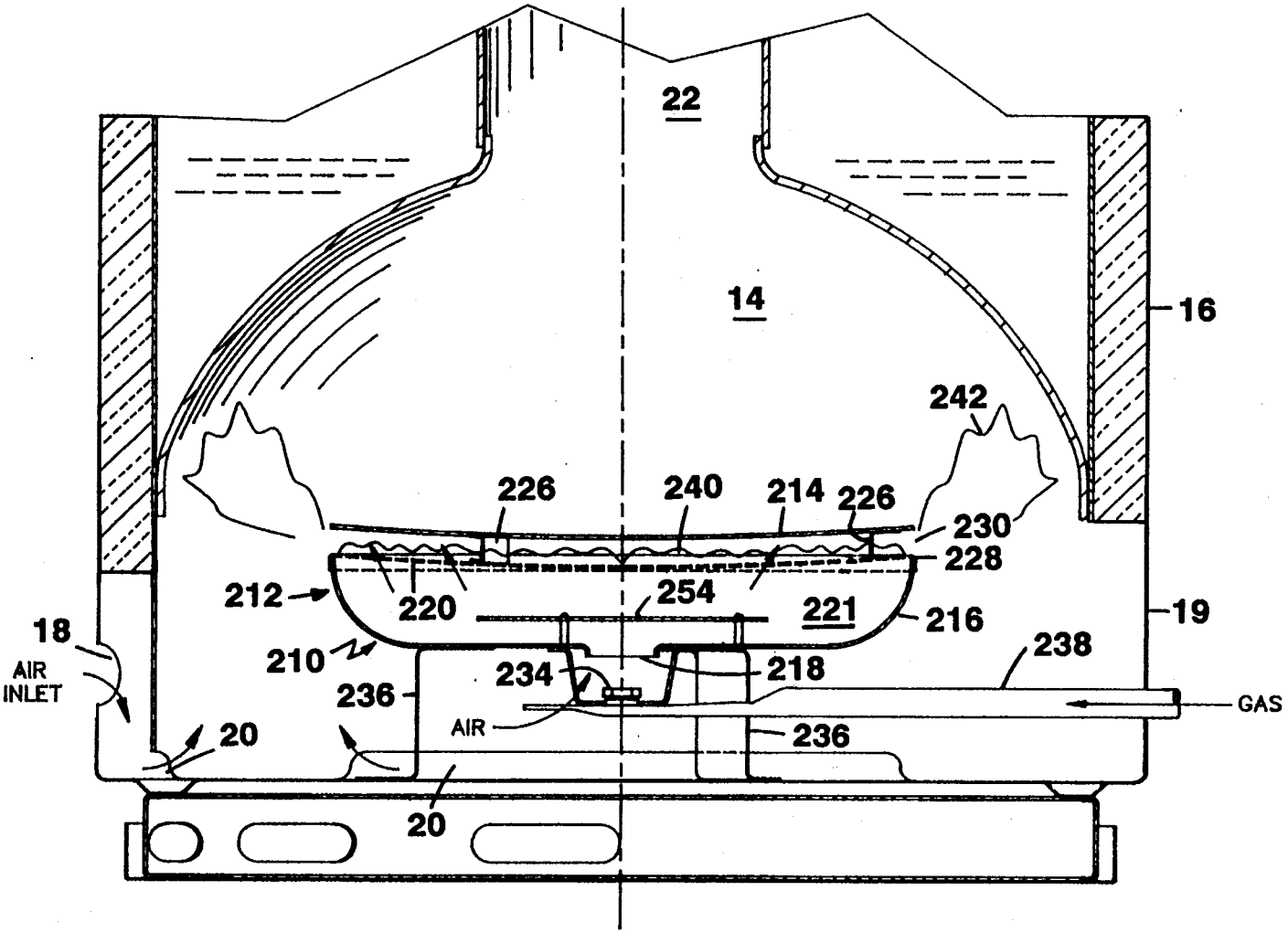

In an alternative embodiment of a low $NO_x$ burner, as shown in FIGS. 5–7, reference numerals having the same last two digits as reference numerals in FIGS. 1–3 indicate corresponding, equivalent, or identical structure. For example, gas line 238 and injector nipple 234 are identical to gas line 138 and injector nipple 134, respectively; standoffs 226, 236 are equivalent to stand-offs 126, 136, respectively. (This system of labeling will be used throughout this disclosure, except for the last embodiment described.)

The primary difference between the two embodiments is in the construction of first stage burners 112 and 212. First stage burner 212 utilizes a much flatter, but still slightly concave, perforated plate 220 which corresponds to top bowl 120. The entire surface of perforated plate 220 is perforated—as indicated by stippling 224—with perforations as per FIG. 4, and first stage flame 240 (FIG. 3) is essentially directed upwards. Mixing baffle 254 is provided so as to ensure adequate mixing of the gas and air flowing into plenum 221 through gas inlet 218.

Low $NO_x$ burner 210 operates on the same principle as low $NO_x$ burner 110. First stage combustion is run fuel rich, with approximately 60% of the oxygen needed for stoichiometric combustion provided by atmospherically supplied air. The stream of effluent produced by first stage combustion ignites spontaneously as it flows through second stage burn gap 230 and mixes with atmospherically supplied air, thereby completing combustion of the gas.

Low $NO_x$ burner 210 is easier and less costly to construct than low $NO_x$ burner 110, due to the simpler shape of, and smaller amount of material required to fabricate, perforated plate 220 it. Top plate 214 is more directly exposed to first stage flame 240, however, and therefore gets hotter than top plate 114. Heat radiated downward from top plate 214 increases the flame temperature of first stage flame 240, resulting in slightly higher $NO_x$ emissions than burner 110.

Figure 8:
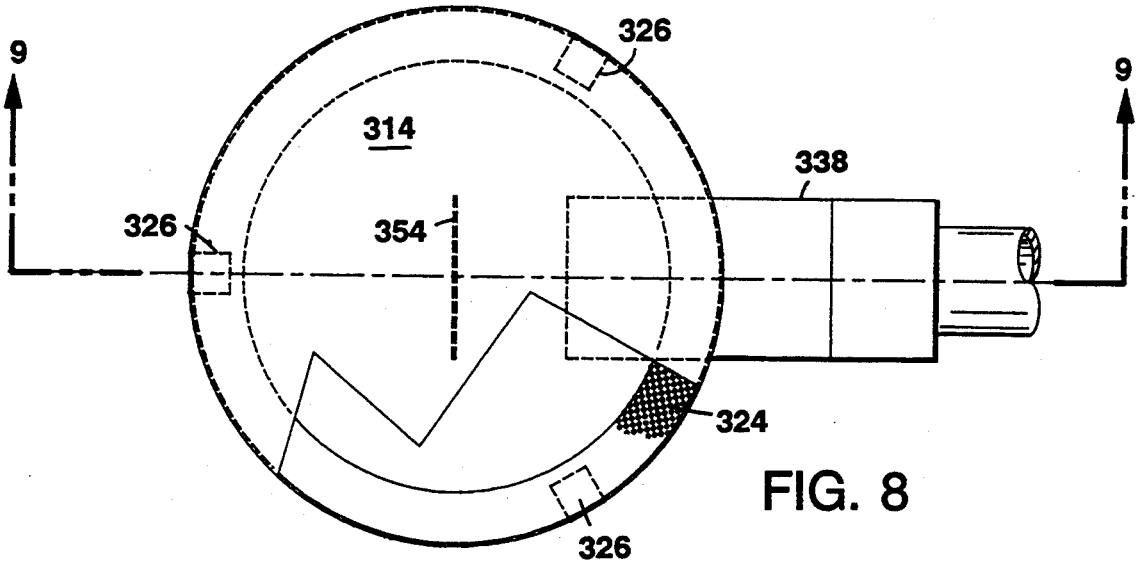
Figure 9:
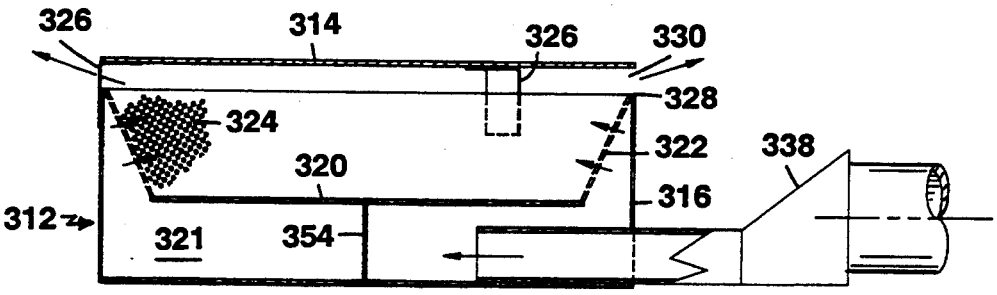
Figure 10:
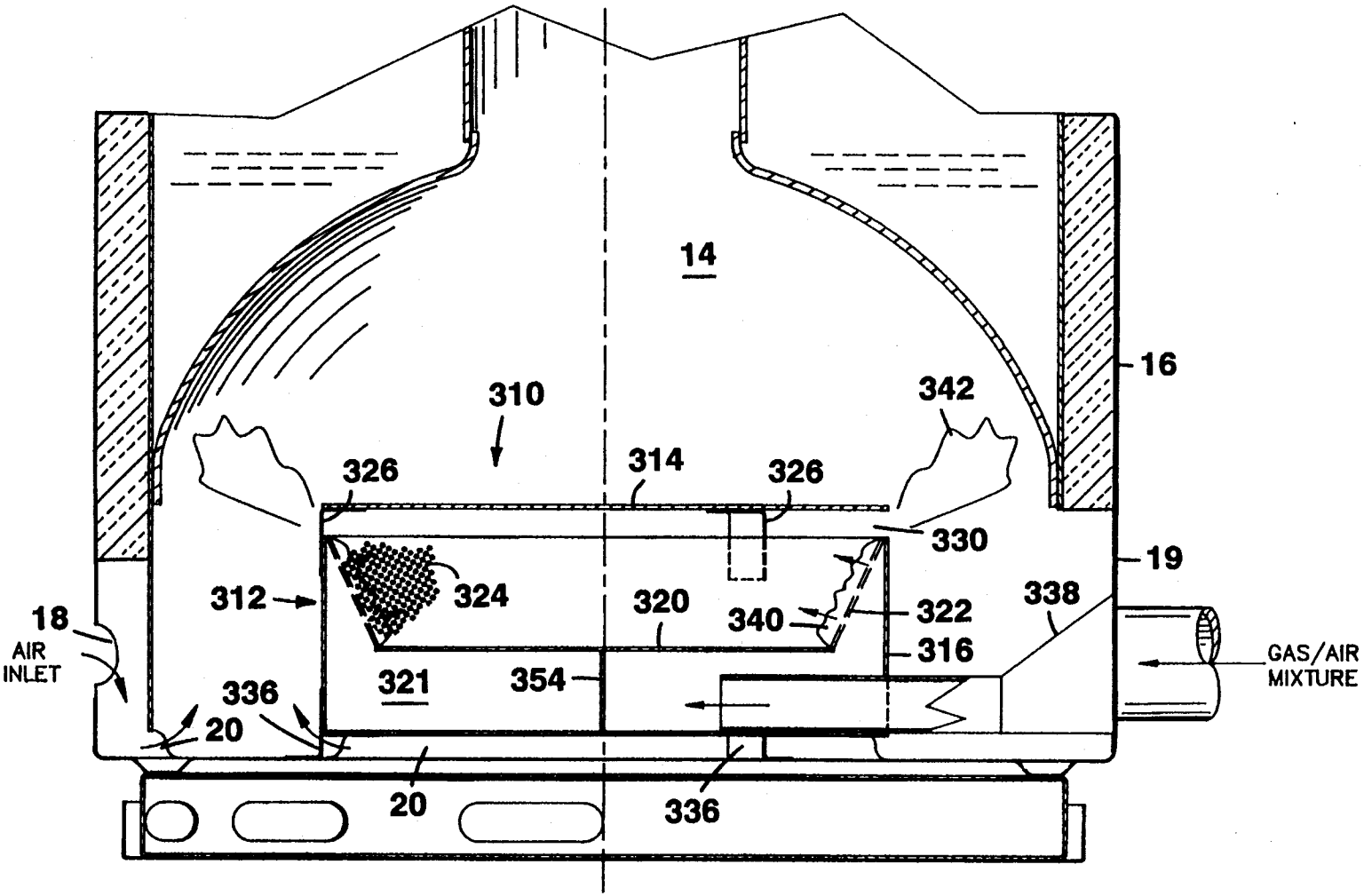

Another alternative embodiment, as shown in FIGS. 8–10, is also similar to that shown in FIGS. 1–3. In the embodiment shown in FIGS. 1–3, gas line 138 supplies raw gas to the burner, and oxygen for first stage combustion is supplied by atmospheric air aspirated into first stage burner 112 by the jet of gas being injected by injector nipple 134. In the embodiment shown in FIGS. 8–10, on the other hand, gas/air line 338 supplies a mixture of gas and air to the burner, air being mixed with the gas external to burn chamber 14. As in the former embodiment, the air mixed with the gas should supply approximately 60% of the oxygen required for stoichiometric combustion. Oxygen required to complete combustion, in the second stage, is supplied by atmospheric air drawn into burn chamber 14 by natural draft action through air inlets 18 and air slots 20.

Gas/air line 338 injects the gas/air mixture directly into plenum 321. Dispersion baffle 354 is provided to disperse the inflowing gas/air mixture, which results in better distribution throughout plenum 321.

Premixing air with the gas external to burn chamber 14 allows for more precise control of the oxygen supplied to the first stage combustion. The drawback is that, in the event of flash back, flame can travel all the way along gas/air line 338. A flame arrester (not shown) is required to prevent the possibility of flame shooting out of water heater 16, which increases system cost and complexity.

Figure 11:
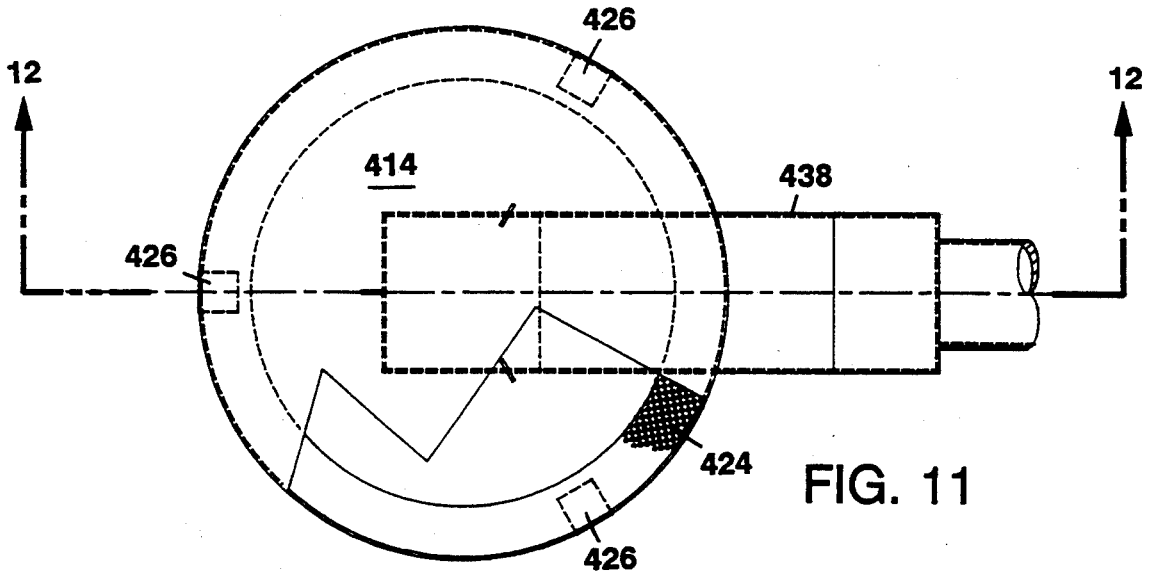
Figure 12:
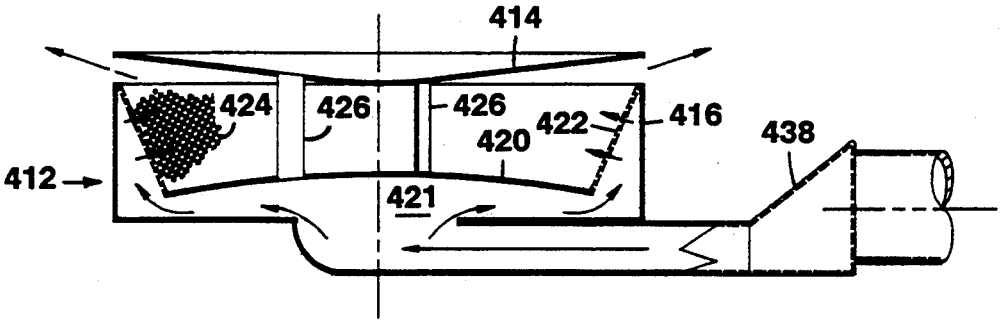
Figure 13:
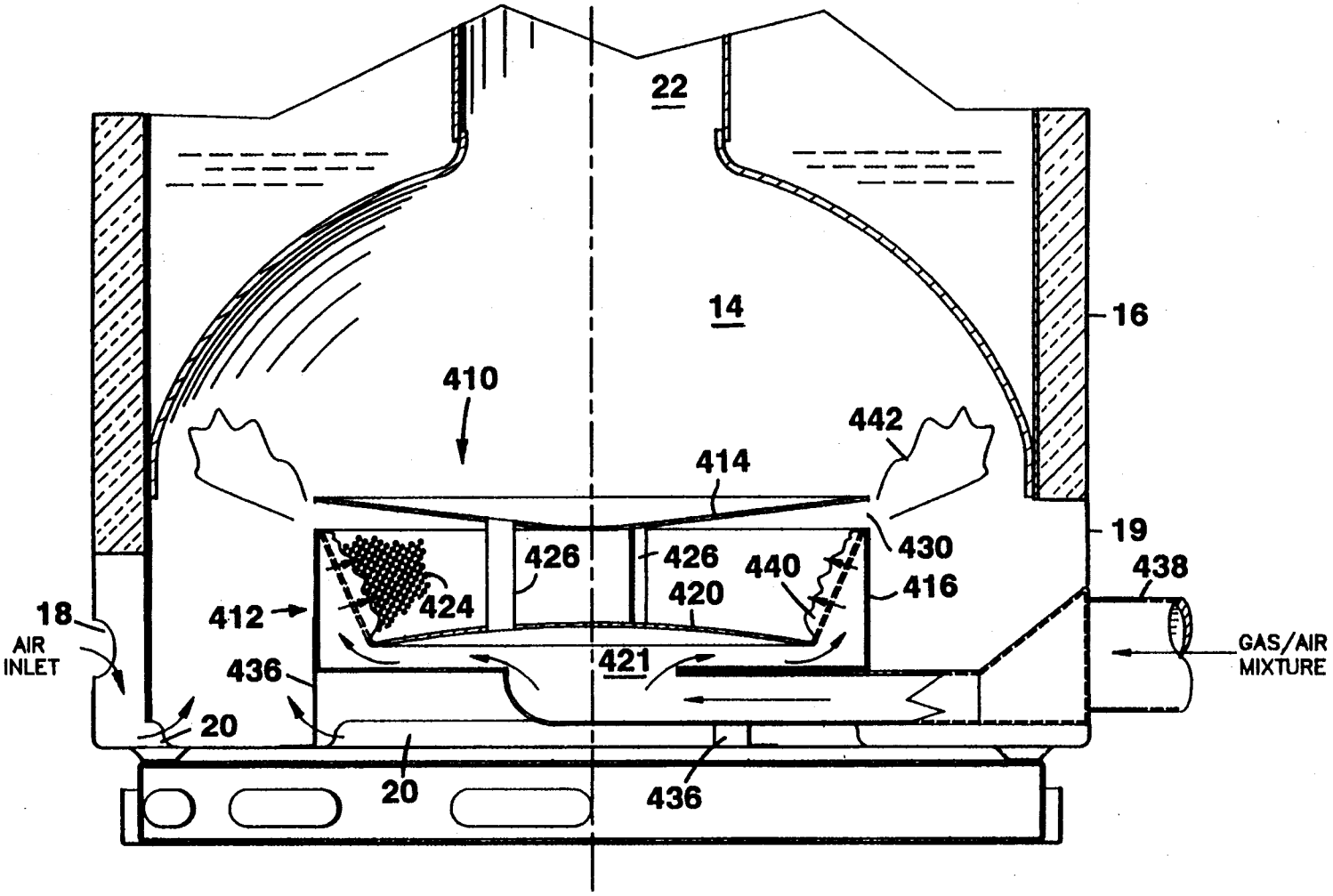

A similar embodiment is shown in FIGS. 11–13. In this embodiment, gas/air line 448 injects a gas/air mixture, containing approximately 60% of the oxygen required for stoichiometric combustion of the gas, into plenum 421 through the center of bottom bowl 416. This embodiment provides an even distribution of gas/air throughout plenum 421, similar to the embodiment shown in FIGS. 8–10. It has the same potential for flash back into the gas/air line 438, however, as the embodiment shown in FIGS. 8–10.

Figure 14:
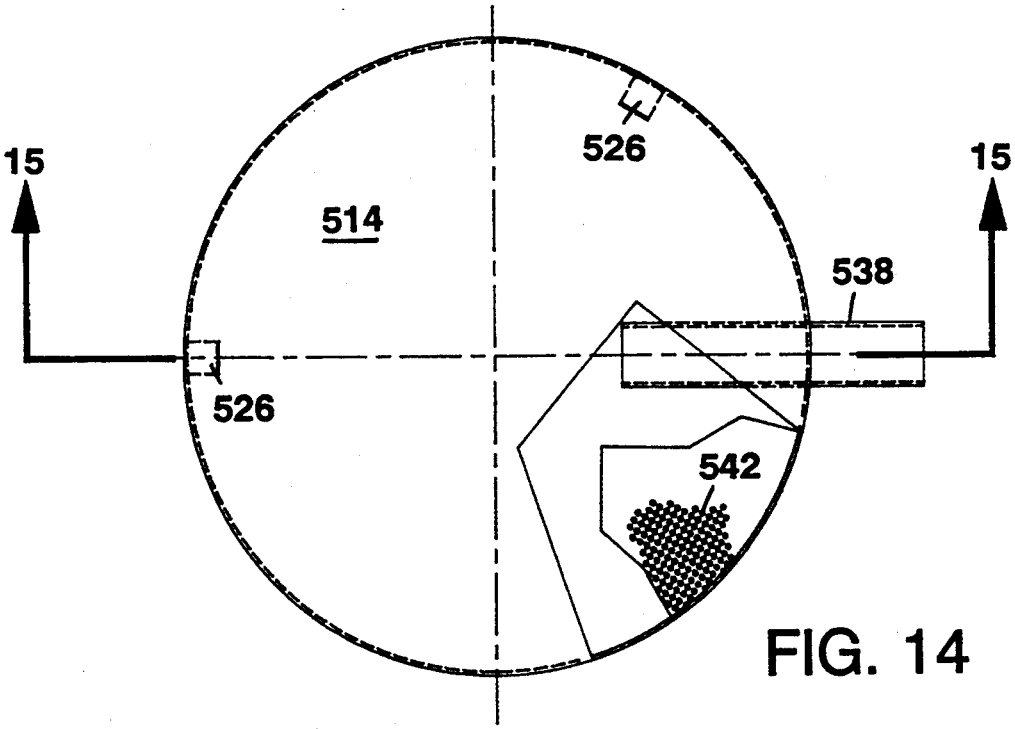
Figure 15:
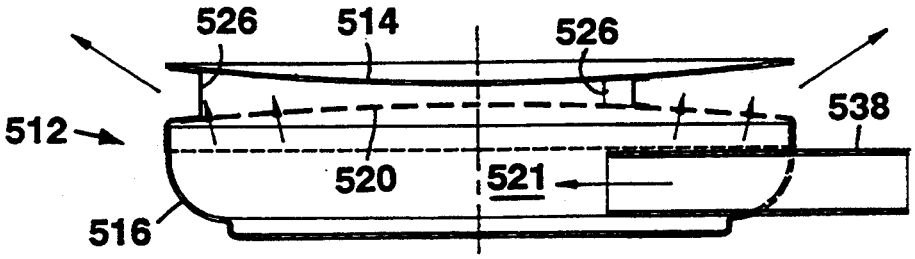
Figure 16:
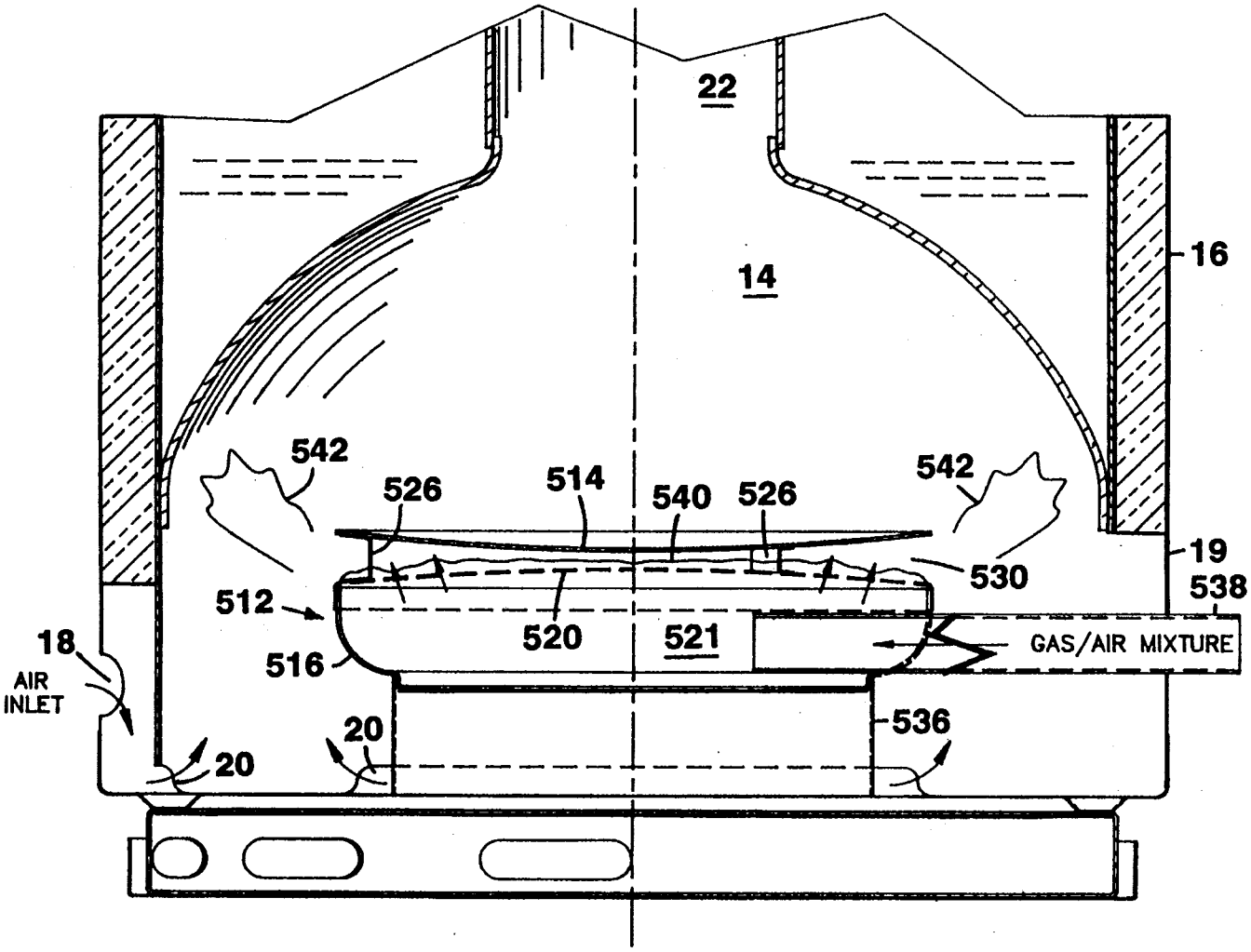

Yet another embodiment is shown in FIGS. 14–16. It is similar to the embodiment shown in FIGS. 5–7 in that first stage flame 540 is supported by the entire surface of perforated plate 520 and fires upward. The primary difference is in the method of introducing the gas and air into the plenum 521. Gas/air line 538 injects a gas/air mixture into plenum 521 from the side of lower bowl 516, with 60% of the oxygen required for stoichiometric combustion of the gas. This configuration is relatively easy to manufacture, but has somewhat nonuniform flame distribution, and the chance of flash back into gas/air line 538 necessitates the use of a flame arrester (not shown).

Figure 17:
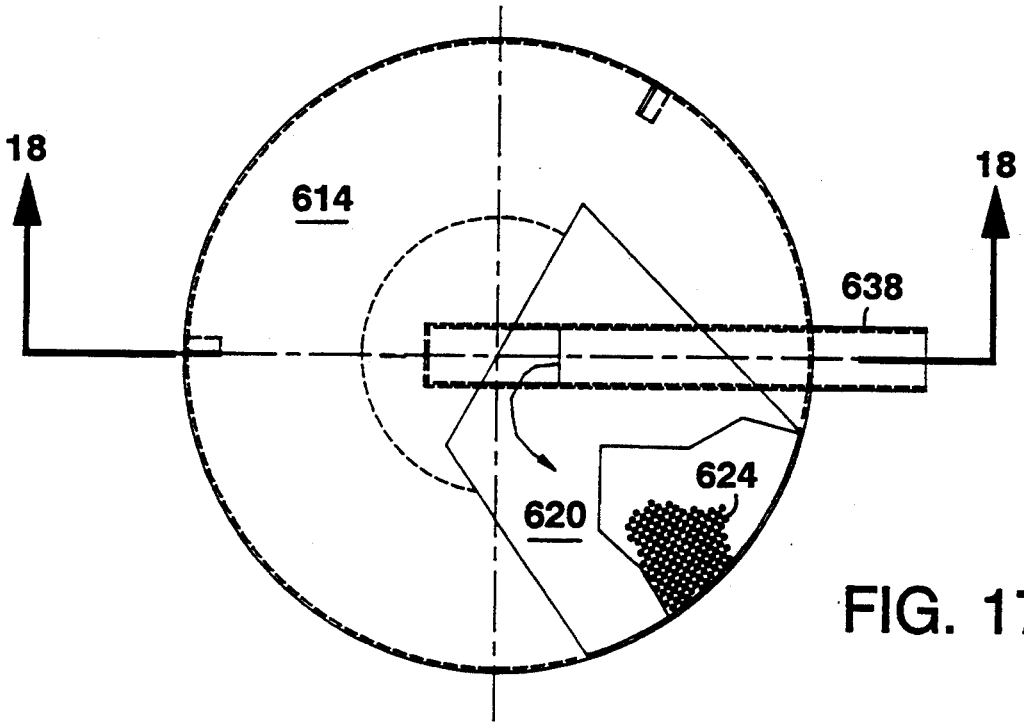
Figure 18:
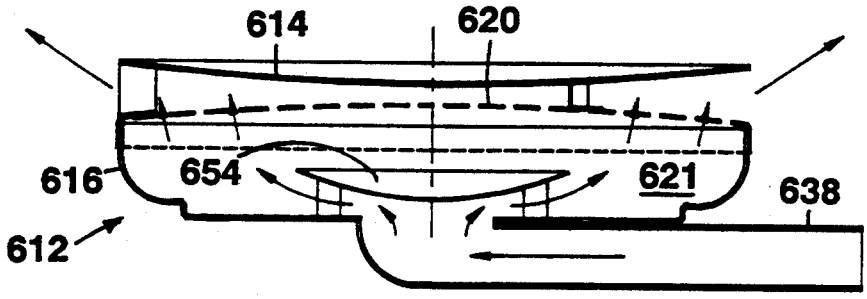
Figure 19:
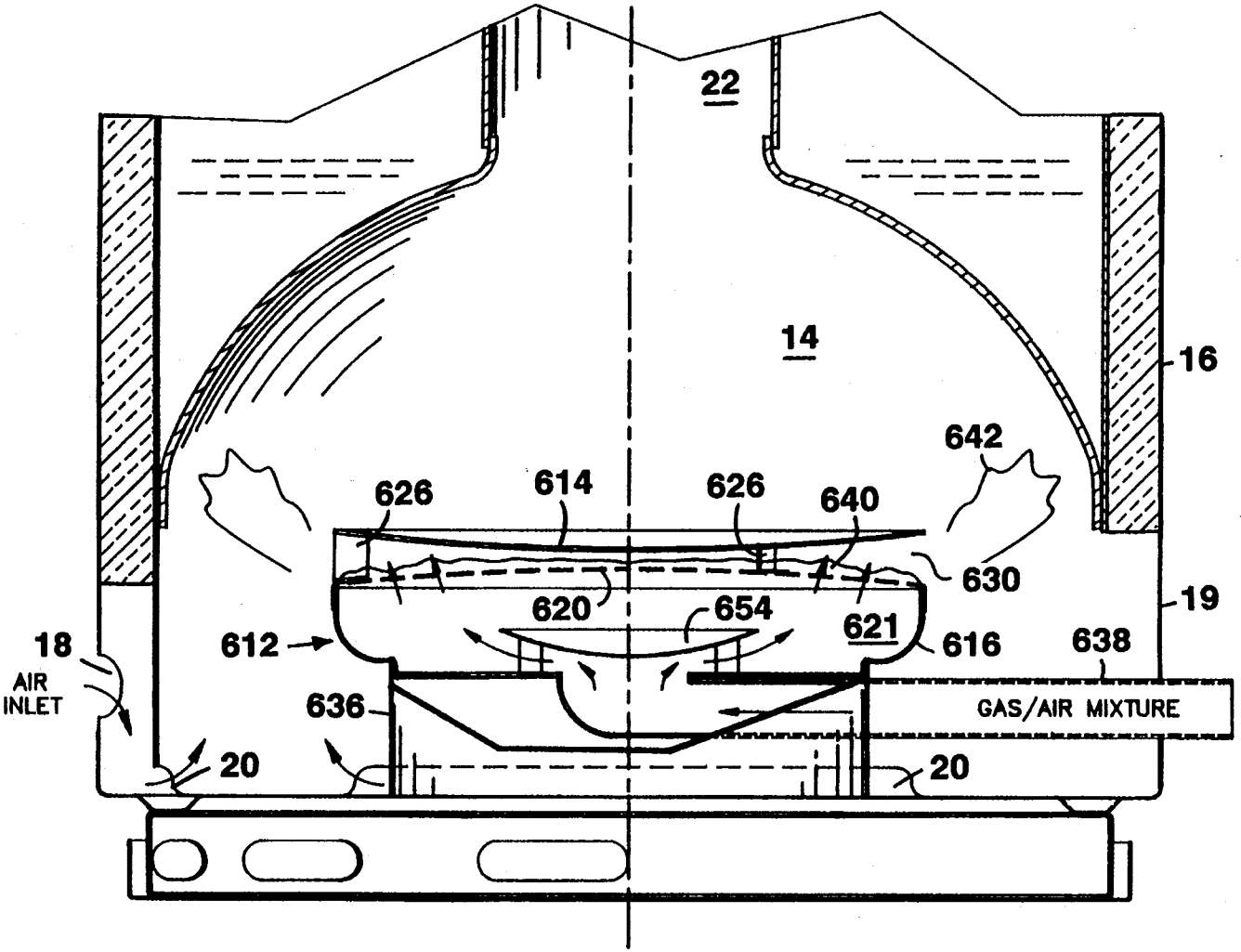

The embodiment shown in FIGS. 17–19 is similar to that shown in FIGS. 14–16. First stage flame 640 is supported over the entire surface of perforated plate 620, and is upwardly directed. Instead of delivering the gas/air mixture into plenum 621 through the side of bottom bowl 616, as is done in the previously described embodiment, the gas/air mixture flows into plenum 621 through the center of bottom bowl 616. This is similar to the manner in which the gas/air mixture is injected in the embodiment shown in FIGS. 11–13. Because plenum 621 is somewhat more voluminous than plenum 421, it is preferable to provide dispersion baffle 654, which disperses the inflowing gas/air mixture throughout plenum 621.

Figure 20:
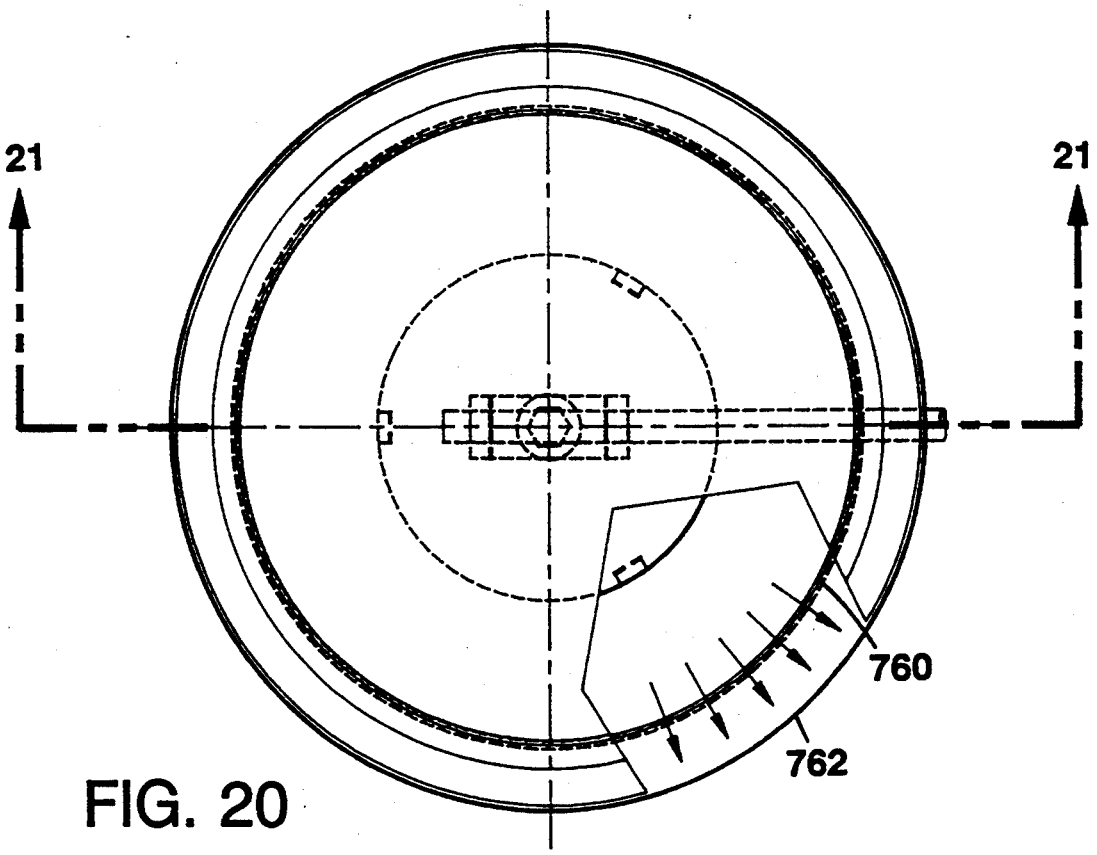
Figure 21:
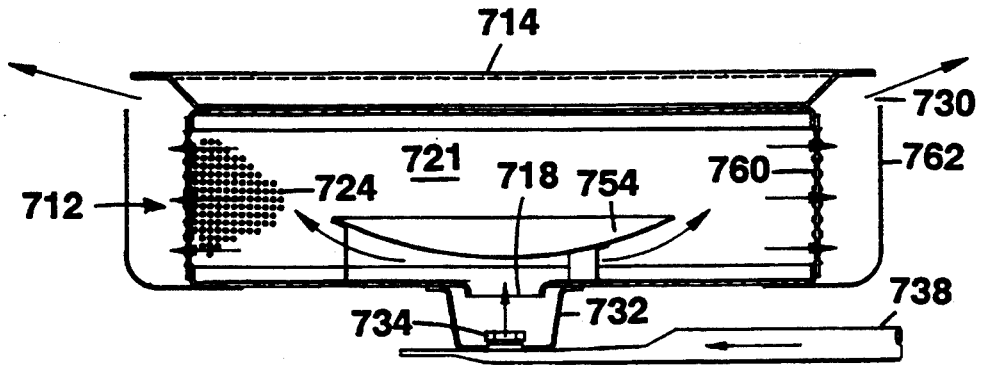
Figure 22:
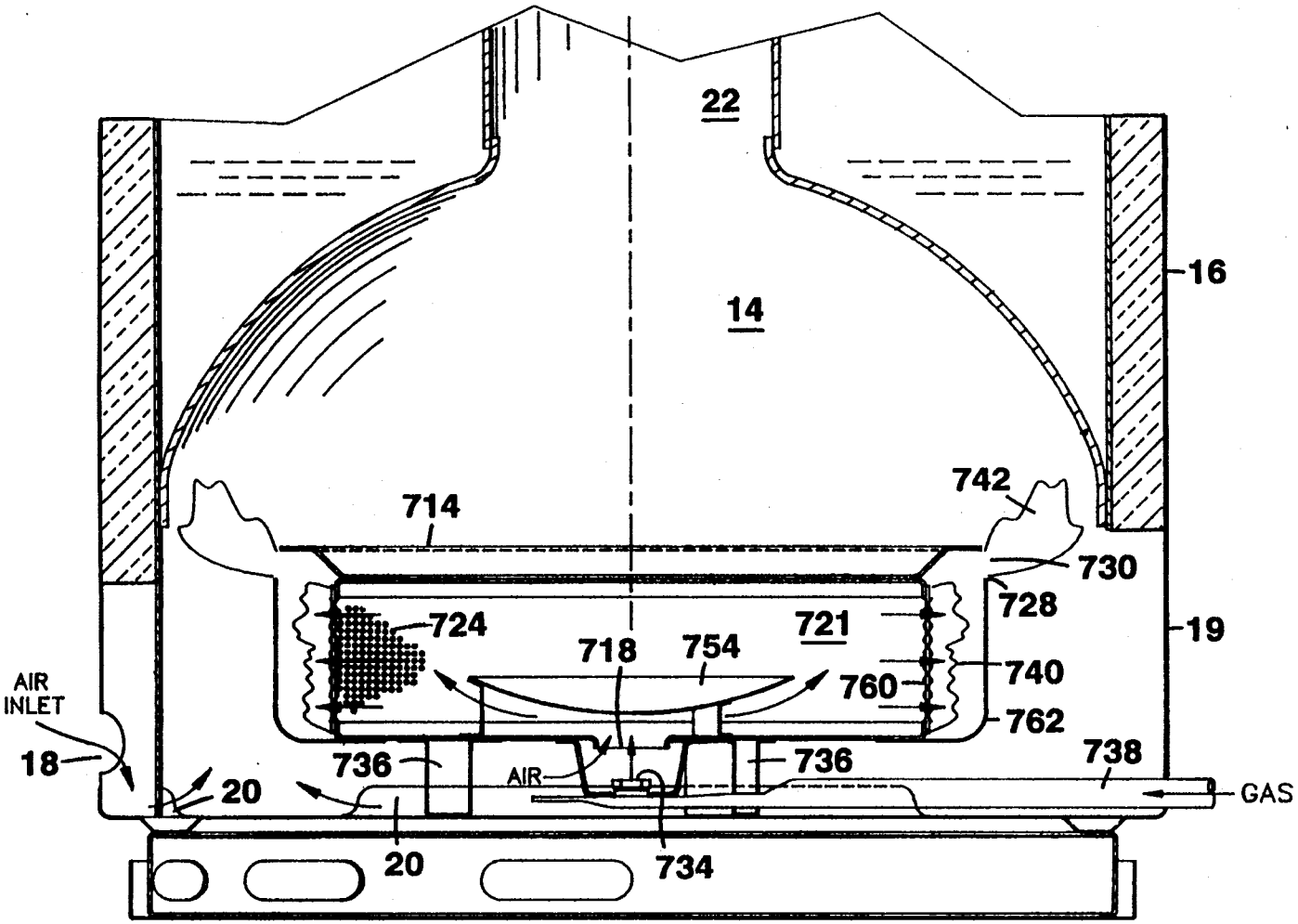

The first stage burners in the embodiments described thus far may described as inward firing or upward firing, perforated plate burners. It is also possible to construct an embodiment, as shown in FIGS. 20–22, which utilizes an outward firing, perforated plate burner. The first stage burner 712 is a hollow, disc shaped drum. The outer wall 760 of the drum is perforated—represented by the stippling 724—in the same manner as the previously described embodiments, the details of which is disclosed in FIG. 4.

In the embodiment shown in FIGS. 20–22, gas line 738 supplies gas to first stage burner 712, and the gas is injected into plenum 721 by injector nipple 734 through gas inlet 718. Oxygen necessary for first stage combustion is provided by atmospherically supplied air which is aspirated into plenum 721 by the inflowing jet of gas, as is described above with reference to FIGS. 1–3. As in all of the other embodiments, approximately 60% of the oxygen necessary for stoichiometric combustion of the gas should be provided for the first stage combustion. Proper proportioning may be effected by varying the mass flow rate and/or velocity of the gas being injected, the diameter of gas inlet 118, or the choke effect created by the proximity of top bowl mixer baffle 754 to gas inlet 718. Mixer baffle 754 is provided above gas inlet 718 to enhance mixing of the air and gas.

The gas/air mixture flows through perforated outer wall 760 and is ignited by a standing gas pilot (not shown), producing first stage flame 740. Air baffle 762, which surrounds first stage burner 712 and extends below it, prevents premature mixing of the stream of effluent produced by first stage flame 740 with atmospheric air, which flows into burn chamber 14 through air inlets 18 and air slots 20. Air baffle 762 also shields the lower walls of burn chamber from heat produced by first stage flame 740.

Top plate 714 should be approximately the same diameter as air baffle 762, and should be approximately one inch above the top edge 728. This arrangement defines circumferential second stage burn gap 730. As the stream of effluent produced by first stage flame 740 flows through second stage burn gap 730, it mixes with atmospherically supplied air flow up around air baffle 762 and ignites spontaneously, producing second stage flame 742, which completes combustion of the gas.

Figure 23:
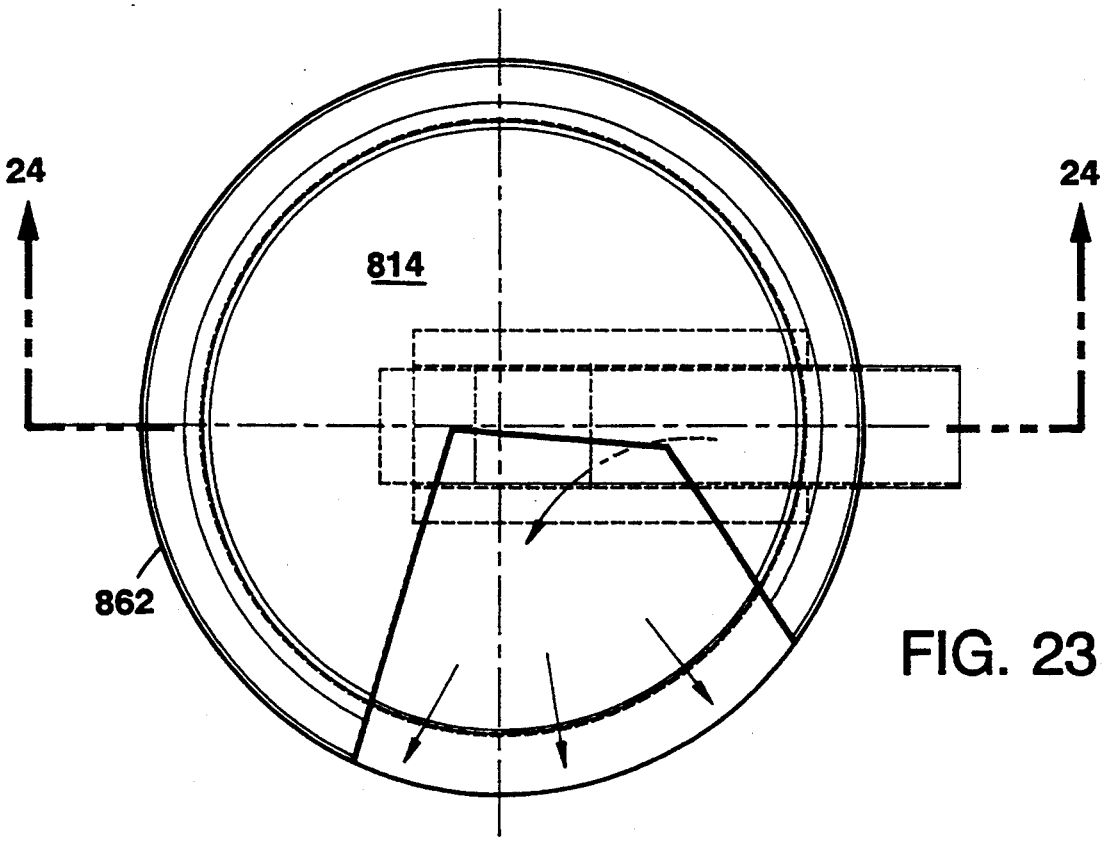
Figure 24:
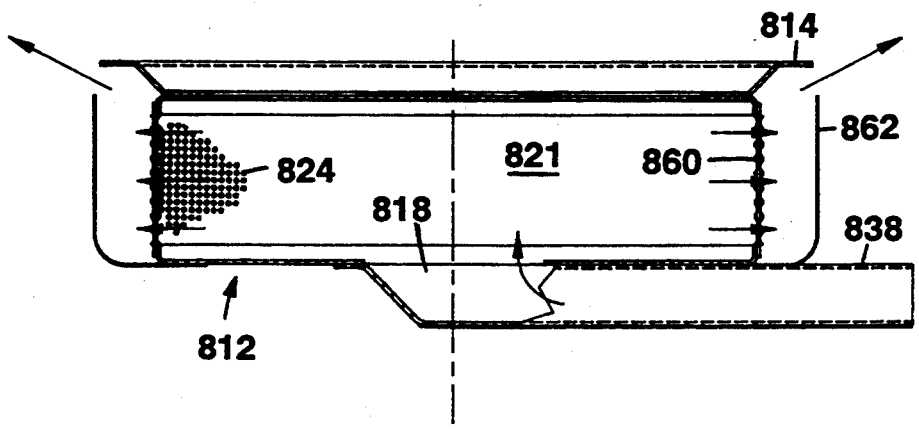
Figure 25:
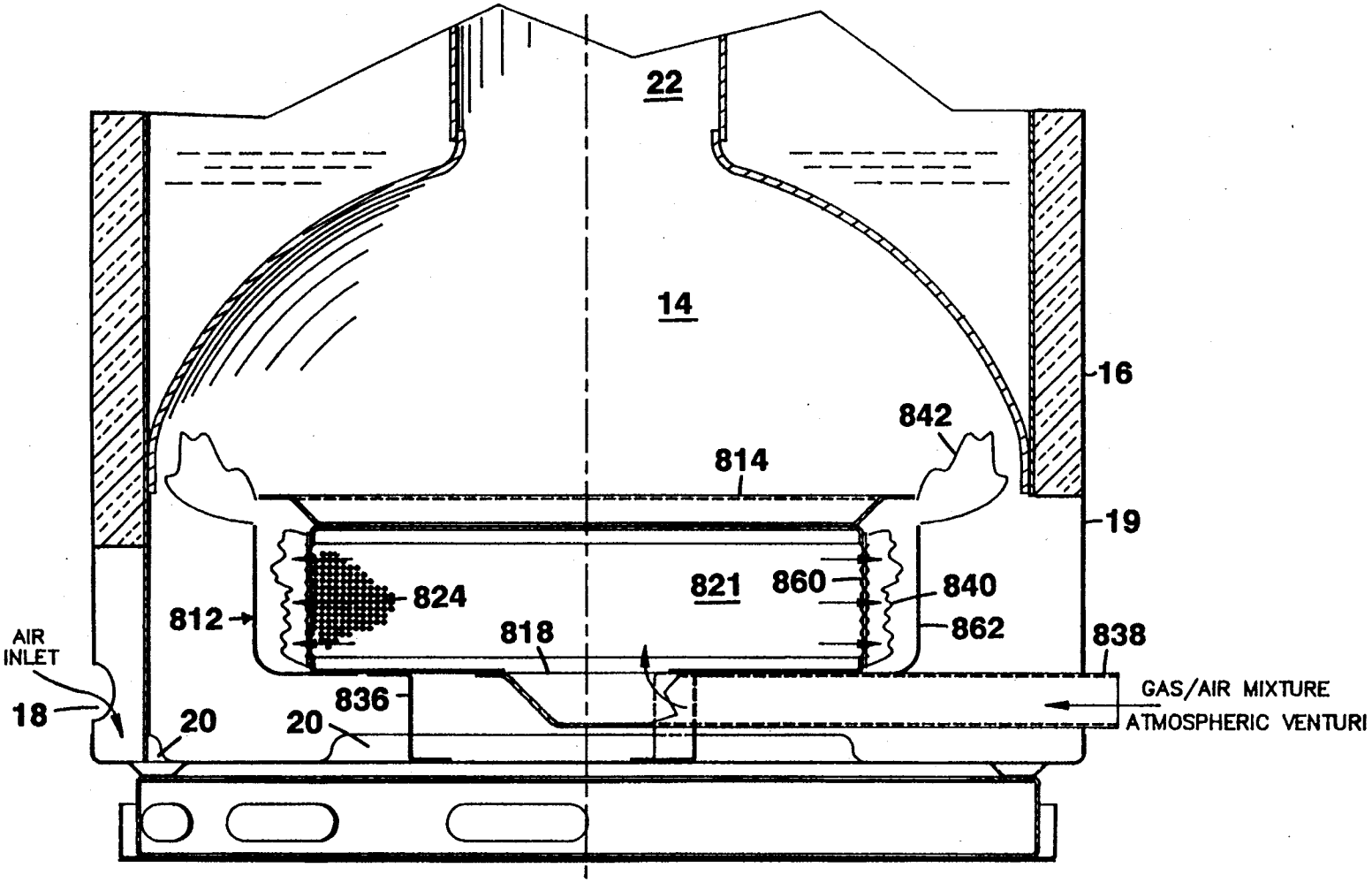

The embodiment shown in FIGS. 23–25 is identical, except the air to support first stage combustion is mixed with the gas external to burn chamber 14. The gas/air mixture flows through gas/air line 838 and into plenum 821 through inlet 818 in the center of the bottom of first stage burner 812.

Figure 26:
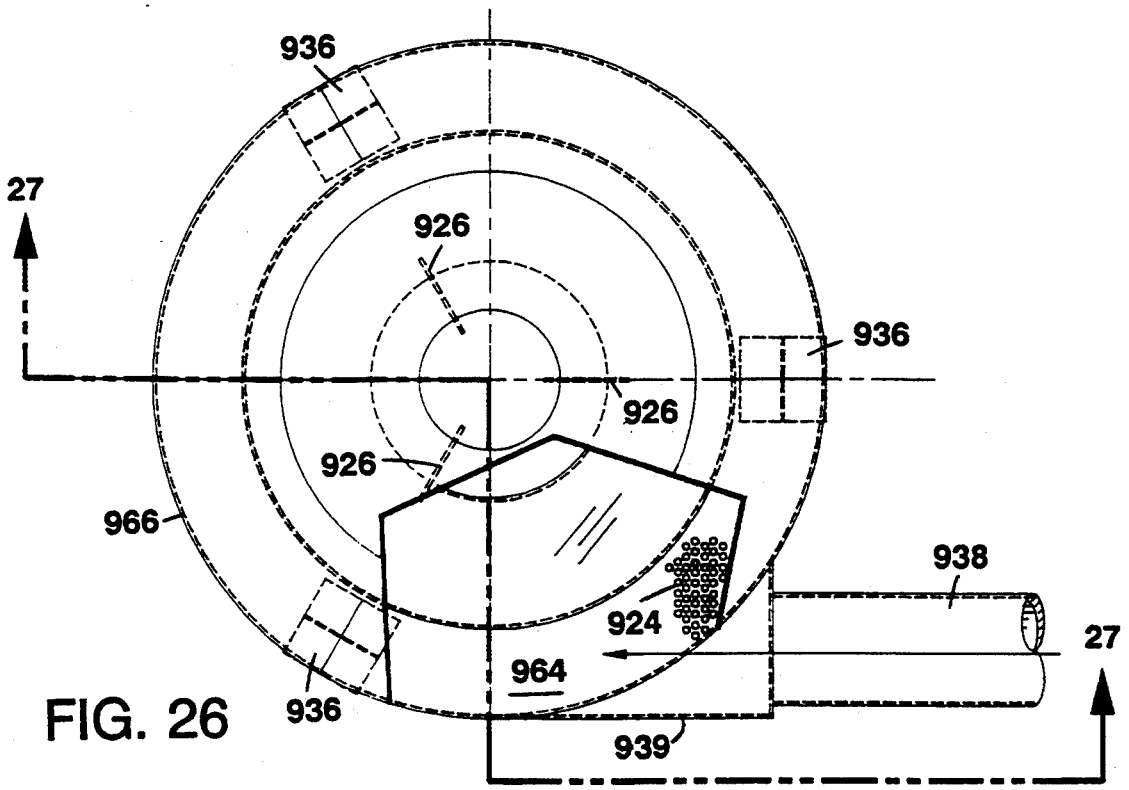
Figure 27:
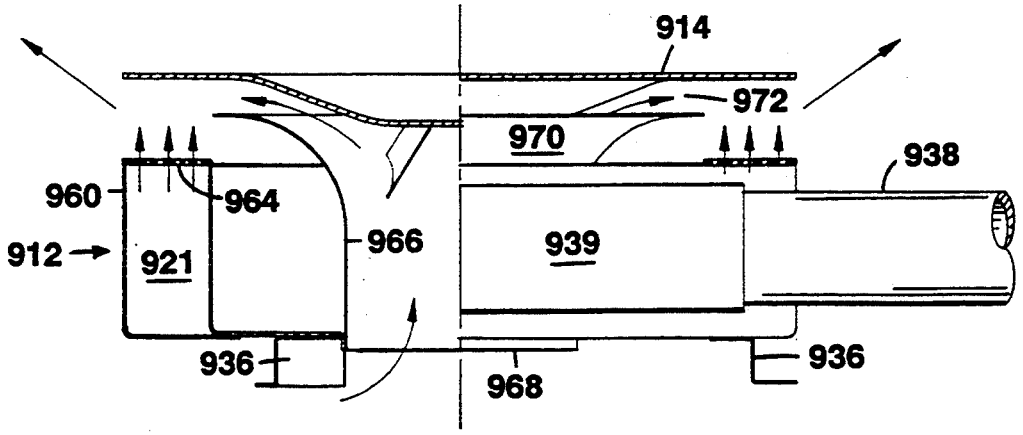
Figure 28:
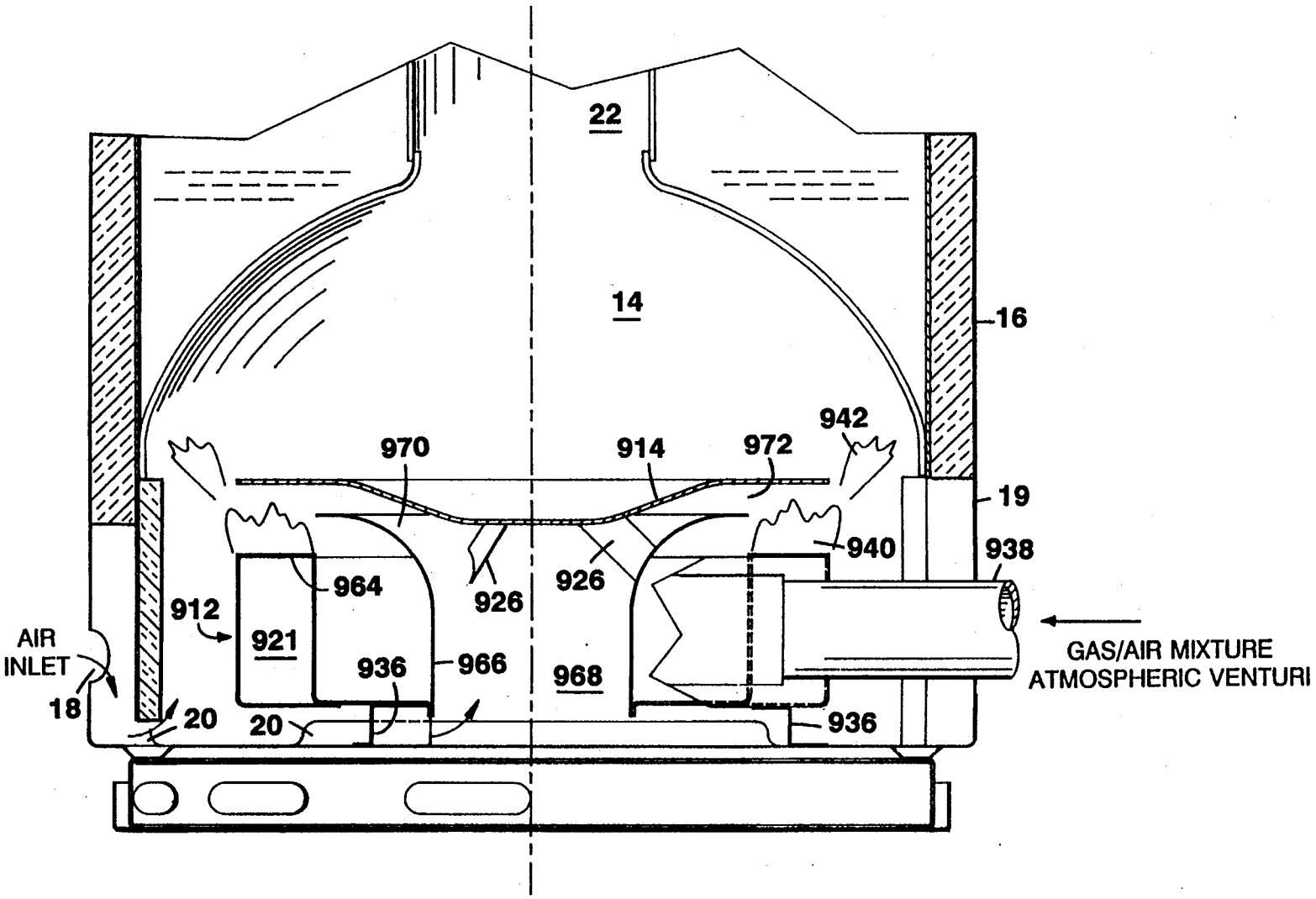

In FIGS. 26–34, another approach to providing the atmospherically supplied air required for second stage combustion is disclosed. As shown in FIGS. 26–28, first stage burner 912 is constructed as a doughnut-shaped toroid, with toroidal plenum 921. Top surface 964 is perforated, as described above with reference to FIG. 4 and represented by stippling 924, so as to support first stage flame 940. A gas/air mixture, with air to provide approximately 60% of the oxygen required for stoichiometric combustion of the gas, is injected tangentially into plenum 921 by gas/air line 938. For ease of construction, adaptor section 939 is welded over an inlet (not shown) in outer wall 960 of first stage burner 912, and gas/air line 938 is welded to adaptor section 939. This configuration provides for excellent circumferential distribution of the gas/air mixture throughout plenum 921.

The major distinction between this embodiment and the others described thus far is the use of center tube 966. Center tube 966 is supported vertically in the center region of first stage burner 912 with its lower end 968 sufficiently above the floor of burn chamber 14 such that atmospheric air flowing into burn chamber 14, through air inlets 18 and air slots 20, may flow up through center tube 966. Top plate 914 is supported by standoffs 926 above fluted upper end 970 of center tube 966. Top plate 914 and fluted upper end 970 define circumferential second stage air gap 972, which directs atmospherically supplied air flowing up through center tube 966 radially into the stream of effluent produced by first stage flame 940. Additionally, part of the second stage air flows upward along the outside of outer wall 960 and mixes with the stream effluent, in a manner similar to the embodiments described thus far. This spontaneously results in second stage combustion, represented by second stage flame 942, which completes combustion of the gas.

The embodiment shown in FIGS. 26–28 has less metal exposed directly to flame, and therefore lower metal temperature, than the previously described embodiments. Furthermore, as second stage air flows through second stage air gap 972, it tends to cool top plate 914.

Figure 29:
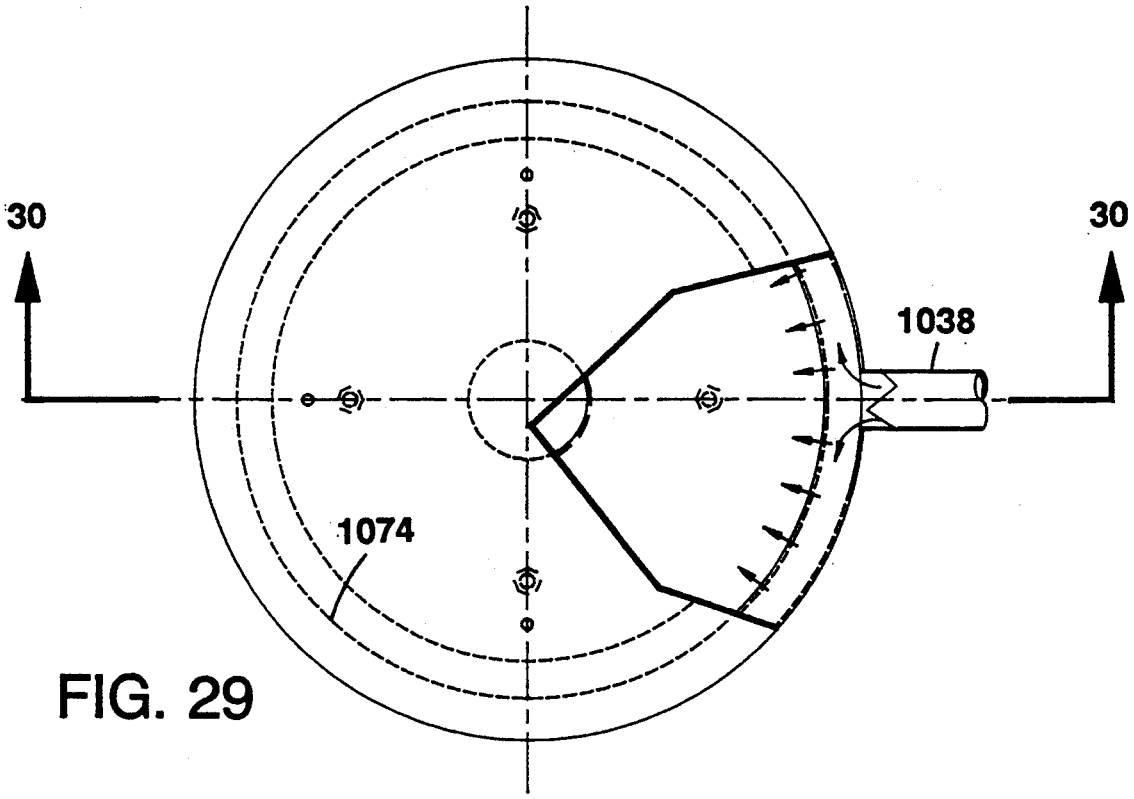
Figure 30:
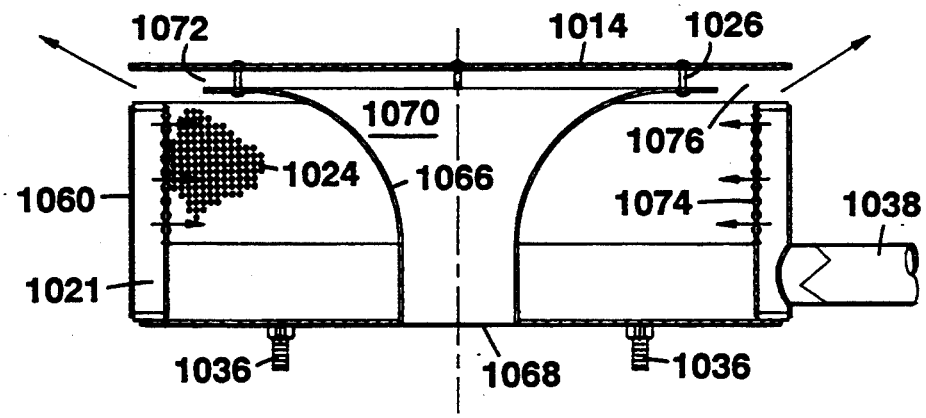
Figure 31:
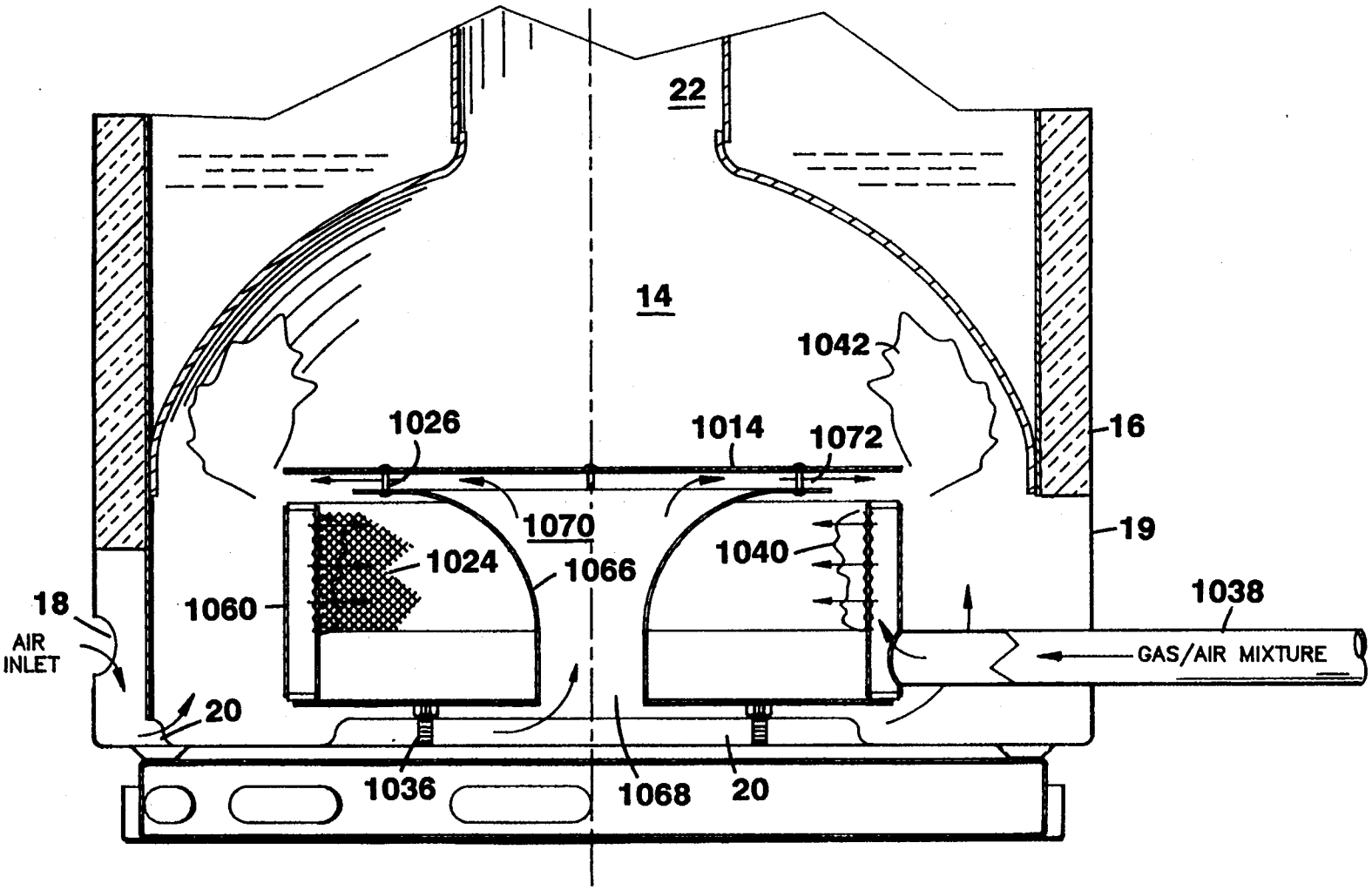

A similar embodiment is shown in FIGS. 29–31. In this embodiment, inner wall 1074 rather than outer wall 1060 is perforated to support first stage flame 1040. Inner wall 1074 is not perforated over its entire surface, but only over the upper portion. Gas/air line 1038 injects a gas/air mixture perpendicularly into plenum 1021, below the area of inner wall 1074 which is perforated. As it strikes the non-perforated section of inner wall 1074, the gas/air mixture disperses throughout plenum 1021, as shown in FIG. 29.

With respect to the center tube structure, the embodiment shown in FIGS. 29–31 is quite similar to that shown in FIGS. 26–28. The stream of effluent produced by first stage flame 1040 flows through gap 1076, defined by fluted upper end 1070 of center tube 1066 and inner wall 1074. It mixes with atmospherically supplied air flowing out of second stage air gap 1072, spontaneously producing second stage combustion, represented by second stage flame 1042. Additionally, part of the second stage air flows upward along the outside of outer wall 1060, as in the embodiment shown in FIGS. 26–28.

Figure 32:
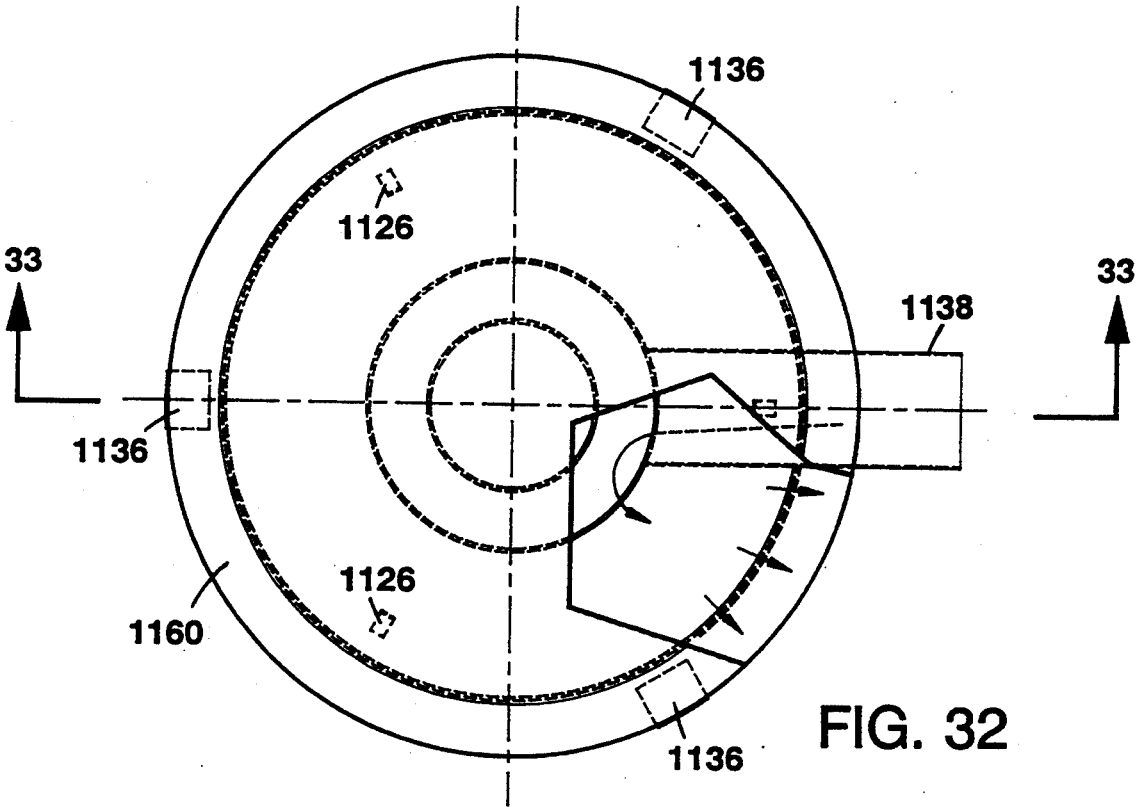
Figure 33:
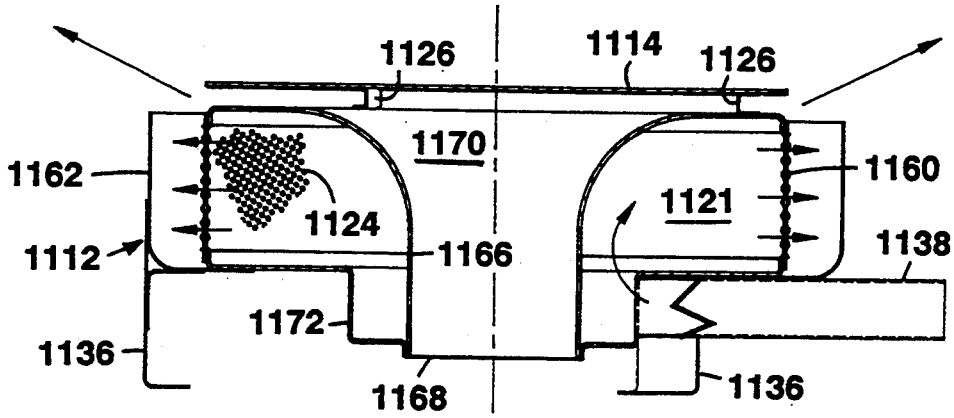
Figure 34:
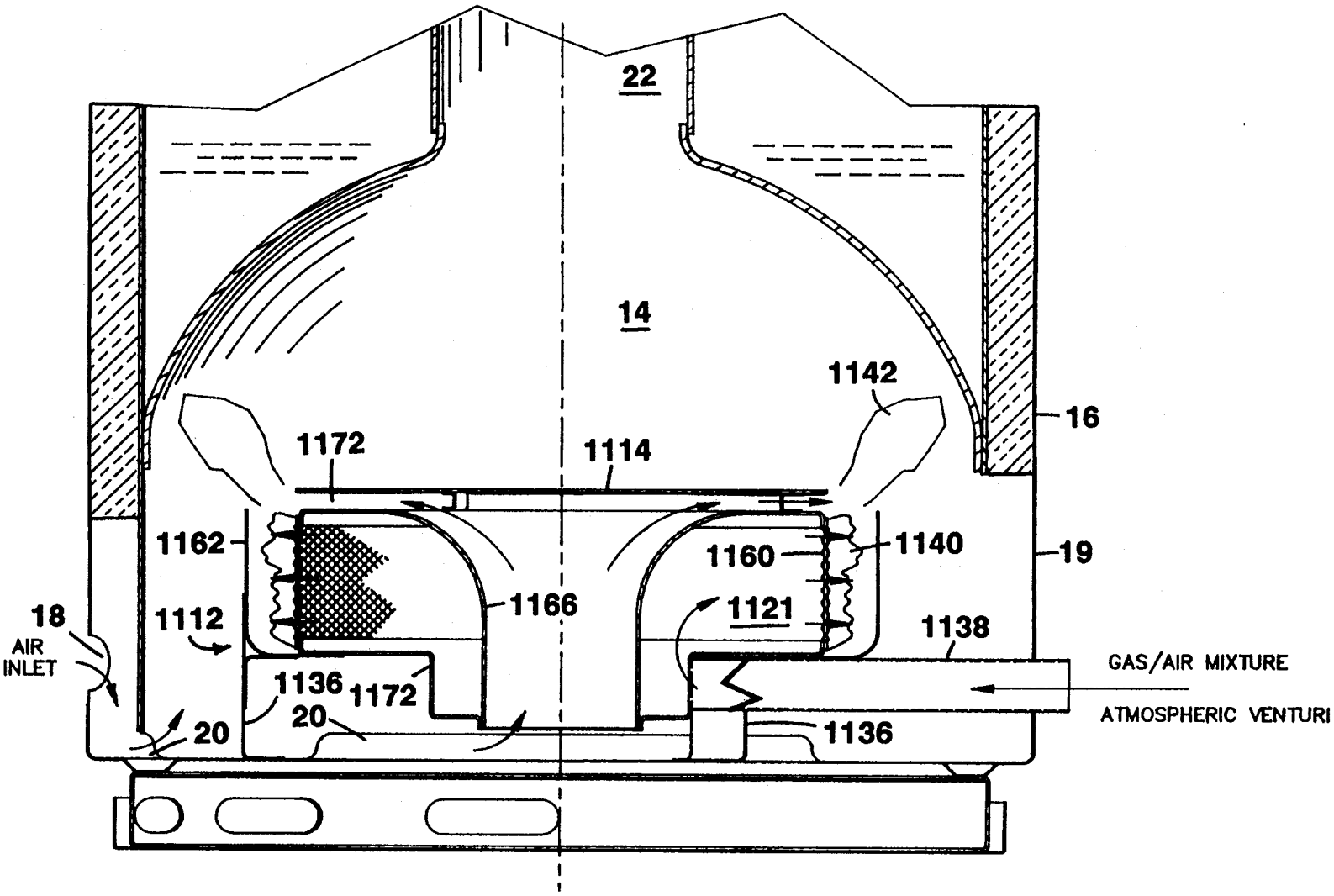

As shown in FIGS. 32–34, outer wall 1160 may be perforated, yielding an outward firing first stage burner 1112. In this embodiment, plenum 1121 is bounded in part by center tube 1166, the fluted upper end 1170 of which defines the upper portion of the plenum.

The gas/air mixture is injected by gas/air line 1138 into drop-down region 1172, at the bottom of first stage burner 1112. Air baffle 1162 surrounds the first stage burner and directs the stream of effluent produced by first stage flame 1140 into the stream of atmospherically supplied air flowing out of second stage air gap 1172, spontaneously producing second stage combustion, represented by second stage flame 1142.

Figure 35:
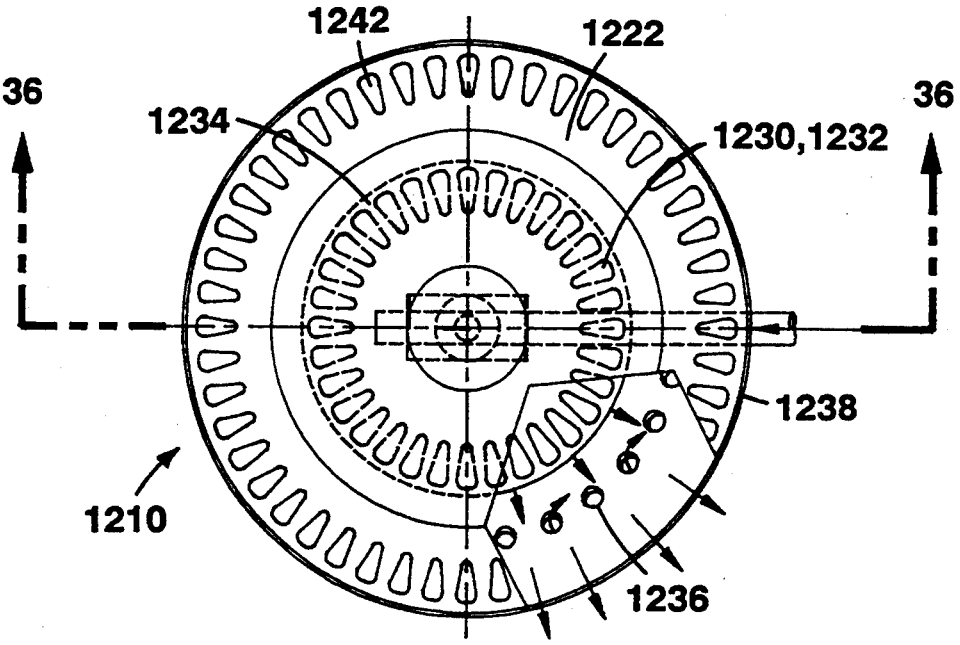
FIGS. 35–37 are schematic drawings showing a two-stage, low $NO_x$ burner using a conventional burner head, according to a second aspect of the invention. The same "group-of-three-Figures" format is followed.
Figure 36:
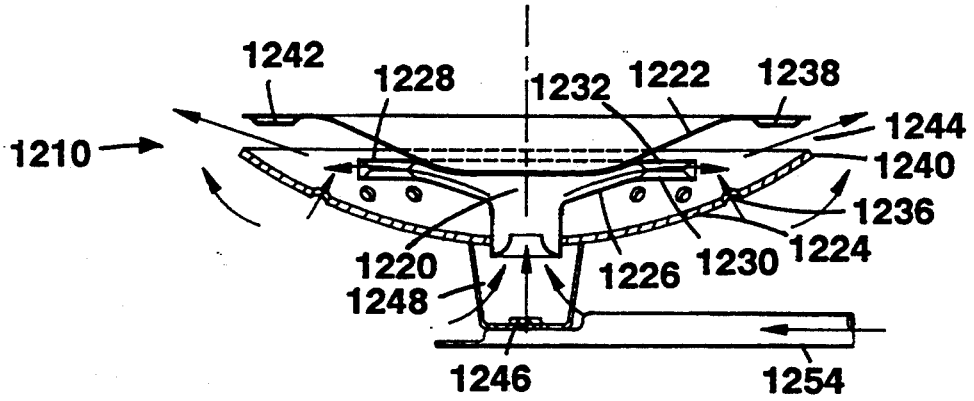
Figure 37:
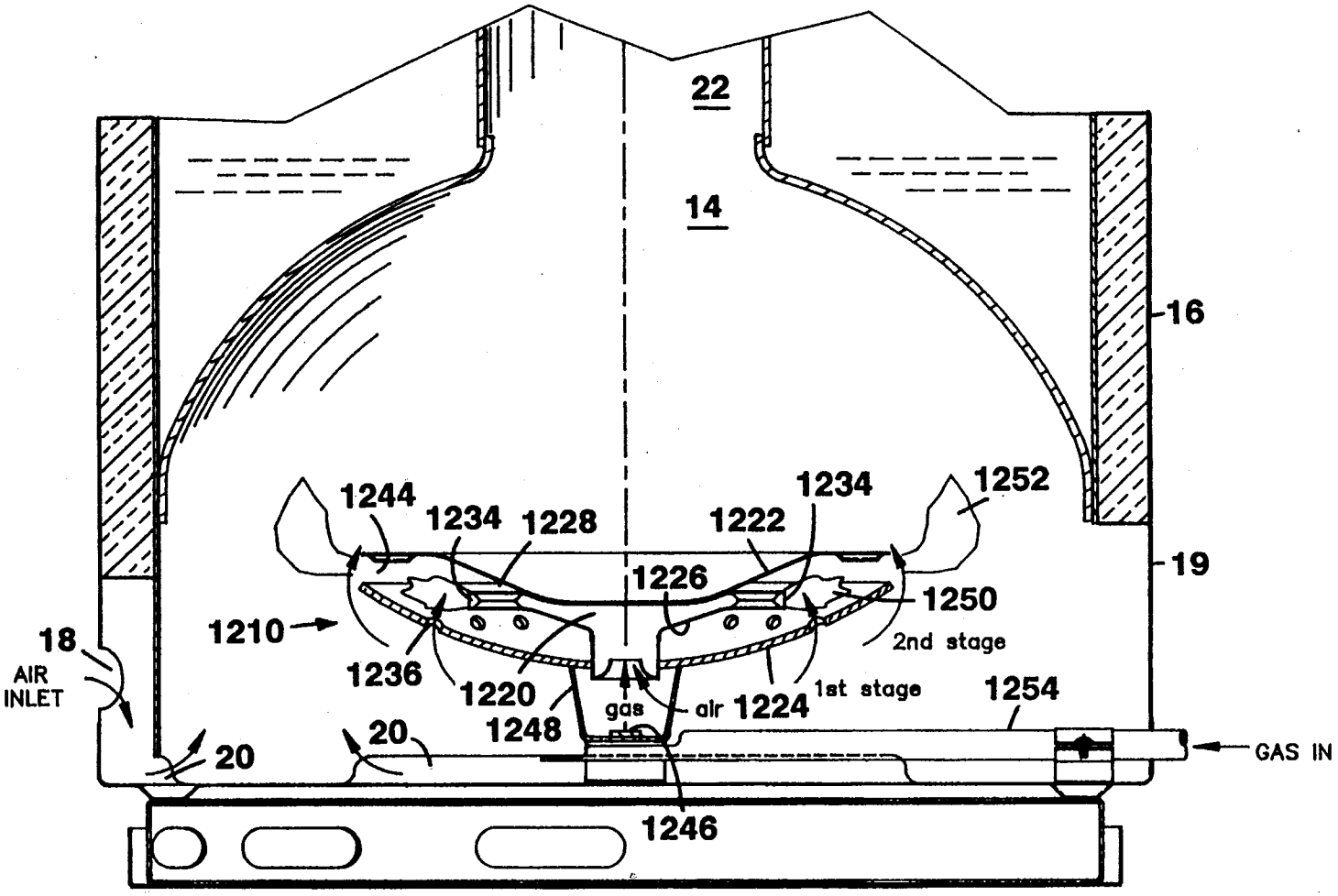

An embodiment which is quite different from those described thus far is shown in FIGS. 35–37. (The reference numbers used to describe this embodiment bear no relation to the reference numbers used to describe the previous embodiments.) Atmospherically supplied, low $NO_x$ burner 1210 comprises a circumferentially outward firing first stage burner head 1220, top plate 1222, and bottom baffle 1224. First stage burner head 1220 is a fairly typical burner head as may be found in most residential water heaters. It consists essentially of fluted bottom portion 1226 and mating top portion 1228. Embossed dimples 1230, 1232, located around the circumference of bottom portion 1226 and top portion 1228, respectively, are spot welded to each other in back-to-back fashion to form a circumferential series of first stage burn ports 1234 between successive dimples.

First stage burner head 1220 is cupped from below by bottom baffle 1224. A series of first stage air vents 1236 is located circumferentially about bottom baffle 1224, approximately at the radial location where bottom baffle 1224 is closest to first stage burn ports 1234.

Top plate 1222, shown as somewhat dish-shaped, is affixed to top portion 1228 of first stage burner head 1220. It is important for top plate 1222 to be of greater diameter than first stage burner head 1220, and for top plate 1222 to be configured or positioned such that its outermost edge 1238 is located above the outermost edge 1240 of bottom baffle 1224. The perimeter of top plate 1222 may be embossed with dimples 1242, which help prevent top plate 1222 from warping. Edge 1238 of top plate 1222 and edge 1240 of bottom baffle 1224 define second stage burn gap 1244.

As shown in FIG. 37, low $NO_x$ burner 1210 is supported above gas nipple 1246 by bracket 1248. Raw gas is supplied to the burner 1210 by gas line 1254 and injected, through gas nipple 1246, upward into the first stage burner head 1220.

Atmospheric air flows into burn chamber 14 through air inlets 18 and air slots 20 located near the bottom of burn chamber 14. Atmospherically supplied air is aspirated into the first stage burner 1220 by the stream of gas being injected by gas nipple 1246 and provides oxygen for the first stage combustion, which is represented by first stage flame 1250. First stage combustion is ignited by a standing gas pilot, which is not shown.

It has been found that the air so aspirated does not provide sufficient oxygen for the first stage combustion. The remainder is supplied by air flowing through first stage air vents 1236, which mixes directly with first stage flame 1250. For optimal reduction of $NO_x$, the total oxygen supplied by the aspirated air and the air flowing through first stage air vents 1236 should be approximately 60% of that required for stoichiometric combustion.

The stream of hot effluent flows from first stage flame 1250 through second stage burn gap 1244. Upon mixing with atmospheric air flowing upward about bottom baffle 1224, the stream of effluent spontaneously ignites in second stage combustion, represented by second stage flame 1252, which completes combustion of the gas.

In addition to reducing the levels of $NO_x$, it is also important to control the levels of carbon monoxide produced by the burner. Assuming the fuel gas is methane, the first stage combustion products are essentially carbon monoxide and hydrogen. It is therefore necessary to "burn out" the carbon monoxide in the second stage combustion according to the equation $CO+O \rightleftarrows CO_2$. The second stage combustion should occur at a combustion temperature of 1500° F.–2000° F., as $NO_x$ forms at temperatures above 2600° F.–2800° F. The desired combustion temperature is achieved by delaying mixing of the second stage air with the stream of effluent. This delay allows the effluent to cool to the appropriate temperature range as heat is transferred to the substance being heated, e.g., the water in the water heater. It is therefore desirable to mix the second stage air with the stream of effluent as high in burn chamber 14 as possible.

A competing design consideration, however, is the capability to remove the burner from the unit in which it is installed. Thus, it should be compact enough to insert and remove it through access hatch 19, and it is undesirable for access hatch 19 to be very large as that would weaken the structure of water heater 16. Even with a compact burner unit, however, satisfactory emissions levels may be obtained.

Test results showing $NO_x$ emission levels obtainable are listed in Table I below.

TABLE I

Comparative $NO_x$ Emissions

| | $NO_x$ Emissions, ppm at 3% by volume excess $O_2$ in flue gas |
|---|---|
| Conventional Multi Port Burner[1] | 60–70 |
| Perforated Plate Staged Burner[2] | 15–20 |
| Conventional Multi Port Burner[3] Two Stage | 20–25 |

[1]Conventional first stage burner head, such as 1220 shown in FIGS. 35–37, without bottom baffle 1224 or top plate 1222.
[2]Any of the embodiments shown in FIGS. 1–3, 5–34
[3]Embodiment shown in FIGS. 35–37.

It is evident that those skilled in the art may now make numerous uses and modifications of and departures from the specific embodiments described herein without departing from the inventive concepts.

What is claimed is:

1. A low $NO_x$ emitting, atmospherically-supplied two-stage burner for combusting fuel gas with air within a burn chamber, said burn chamber having air inlets that allow atmospheric air to flow into said burn chamber by natural draft action, comprising an upwardly-firing first stage burner comprising a bottom bowl and a flame support plate which define a plenum, said flame support plate having perforations over substantially its entire surface so as to allow fuel gas mixed with air to exit said plenum in an upward direction, said perforations being configured and disposed such that said flame support plate will support first stage combustion in a compact burn zone located above and closely adjacent to said flame support plate, a fuel supply line arranged to inject fuel gas into said plenum at a rate such that said first stage combustion runs fuel-rich, thereby producing a stream of effluent from said first stage burner containing unburned fuel gas and substantially no oxygen, and means for mixing said stream of effluent with atmospherically supplied air inside said burn chamber to produce second stage combustion, said means for mixing comprising a top plate disposed above and in proximity to said flame support plate so as to define a circumferential, outwardly directed second stage burn gap through which said stream of effluent flows to mix and combust with oxygen provided by atmospherically supplied air flowing upward about said first stage burner, said burner being relatively simple and compact in construction so as to be suitable for use in small-scale heating applications.

2. The burner of claim 1, wherein said fuel supply line is configured and disposed to inject a jet of raw fuel gas into said plenum, and oxygen for first stage combustion is supplied by atmospheric air aspirated into said plenum by said jet of raw fuel gas.

3. The burner of claim 2 further comprising a baffle disposed within said plenum to ensure mixing of said fuel gas with said atmospheric air and to distribute said air/gas mixture evenly throughout said plenum.

4. The burner of claim 1, wherein approximately 60% of the oxygen required for stoichiometric combustion of the fuel gas is used to burn the fuel gas in said first stage combustion.

5. The burner of claim 1, wherein said fuel supply line is configured and disposed to deliver a premixed mixture of fuel gas and air into said plenum.

6. The burner of claim 5 further comprising a baffle disposed within said plenum to distribute said air/gas mixture evenly throughout said plenum.

* * * * *